US005696475A

United States Patent [19]

Yoshitani et al.

[11] Patent Number: 5,696,475

[45] Date of Patent: Dec. 9, 1997

[54] ELECTROMAGNETIC RELAY

[75] Inventors: Katsumi Yoshitani, Hirakata; Hiromi Nishimura, Takatsuki; Shigeru Tajima, Tokyo-to; Norimasa Kaji, Ibaragi; Fumihiro Kamitani, Mie-ken; Yukiharu Tanaka, Tsu; Takao Morimoto, Hisai; Shiro Maeda, Mie-ken, all of Japan

[73] Assignee: Matsushita Electric Works, Ltd., Osaka, Japan

[21] Appl. No.: 600,175

[22] Filed: Feb. 12, 1996

[30] Foreign Application Priority Data

| | | | |
|---|---|---|---|
| Feb. 15, 1995 | [JP] | Japan | P07-027060 |
| Feb. 15, 1995 | [JP] | Japan | P07-027061 |
| Jul. 26, 1995 | [JP] | Japan | P07-190917 |
| Dec. 15, 1995 | [JP] | Japan | P07-326866 |
| Dec. 15, 1995 | [JP] | Japan | P07-327717 |

[51] Int. Cl.[6] ..... H01H 51/22

[52] U.S. Cl. ..... 335/78; 335/131

[58] Field of Search ..... 335/78–86, 124, 335/128, 131

[56] References Cited

U.S. PATENT DOCUMENTS

| | | | |
|---|---|---|---|
| 4,563,663 | 1/1986 | Niekawa et al. | 335/78 |
| 4,707,675 | 11/1987 | Motoyama et al. . | |
| 5,041,870 | 8/1991 | Imai et al. | 335/80 |

*Primary Examiner*—Lincoln Donovan

[57] ABSTRACT

An electromagnetic relay has a base provided with an insulation enclosure and with a contact block outwardly of the enclosure. An electromagnet block is received within the enclosure and includes a coil, yokes, and an armature extending through the coil along the length of the enclosure. The armature is magnetically coupled to the coil and is movable relative to the yokes upon energization of the coil. A card is provided to connect the armature and a movable contact of the contact block for closing and opening the contact. A cover fitted on the base includes an insulation partition which extends between the enclosure and the contact block to accomplish a double-wall insulation between the electromagnet and the contact block. The card has a trunk for connection with the armature and a cross-piece for connection with the movable contact. The trunk extends into the enclosure through a front is opening thereof to fit around the end of the armature such that the entire length of the armature is insulated from the contact block by the enclosure and by the trunk. The crosspiece extends from the trunk longitudinal outwardly of the enclosure for connection with the movable contact outwardly of the insulation enclosure and partition. Further, the partition is contiguous along substantially the entire length of the enclosure. With these features, the relay can have an improved double-wall insulation between the electromagnet block and the contact block without leaving any insulation break along the length of the electromagnet block.

17 Claims, 18 Drawing Sheets

Fig.7
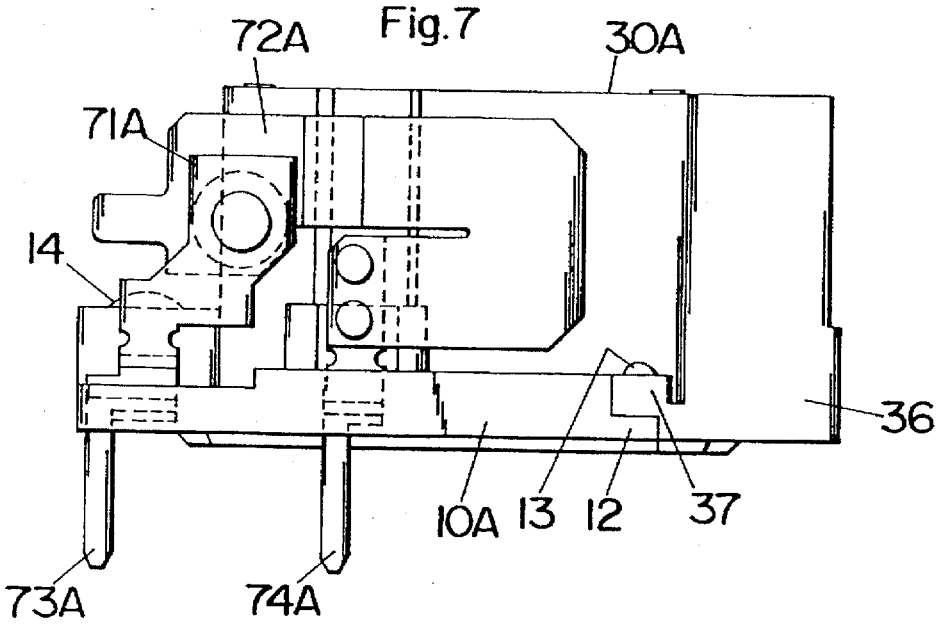
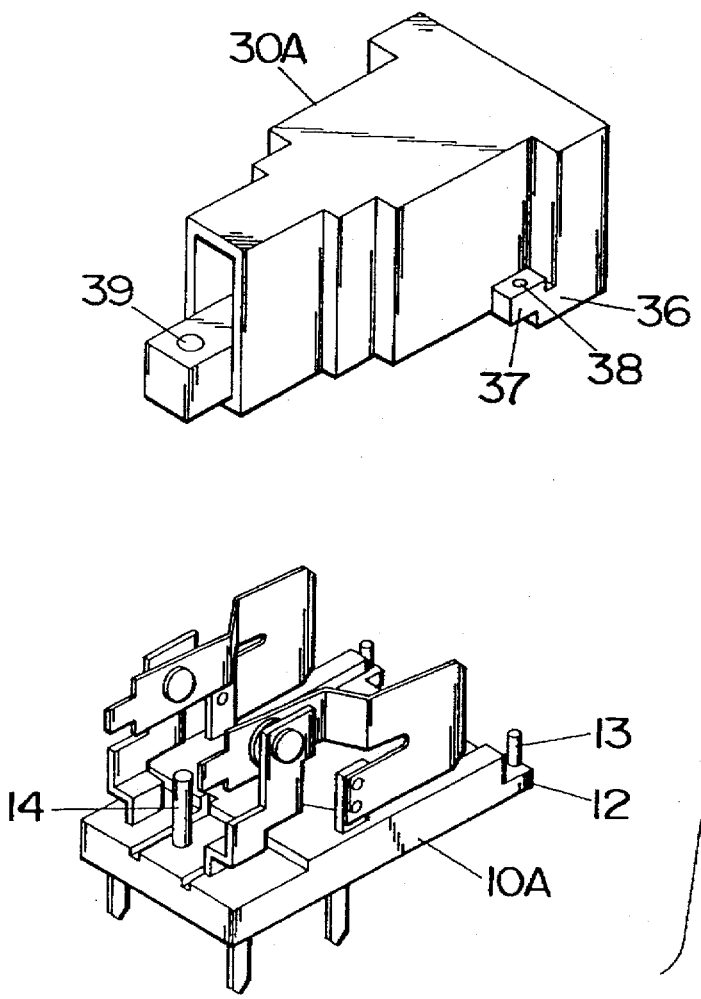
Fig.8

ELECTROMAGNETIC RELAY

BACKGROUND OF THE INVENTION

1. Field of the Invention

The present invention is directed to an electromagnetic relay, and more particularly to an electromagnetic relay with a double-wall insulation structure for electrically insulating a contact block from an electromagnet.

2. Description of the Prior Art

U.S. Pat. No. 4,707,675 discloses an electromagnetic relay with a double-wall insulation structure for electrical insulation between a contact block and an electromagnet. The electromagnet is received within an insulation enclosure provided on a mount base of the relay. The contact block comprises a movable contact and a fixed contact. The movable contact is operatively connected to an armature of the electromagnet and is caused to close and open to and from the fixed contact in response to the energization of the electromagnet. The contact block is disposed on the mount base outwardly of the enclosure adjacent to a side wall of the enclosure. A cover fitted on the mount base is formed with an insulation partition which extends between the contact block and the side wall of the enclosure and is cooperative therewith to establish the double-wall insulation structure between the electromagnet and the contact block. The electromagnet includes an armature which is received in the enclosure and connected to the movable contact through a card of an electrically insulative material. The card is pivotally supported on the top wall of the enclosure and is provided with a contact extension for connection with the contact block outwardly of the enclosure and with an armature extension for connection with the armature. The armature extension projects into the enclosure through a top opening formed at one longitudinal end of the enclosure. In this relay, however, the armature is exposed through the top opening such that the insulation between the armature of electromagnet and the contact block is broken thereat. Further, due to the presence of the contact extension extending from above the enclosure to the contact block, the insulation partition depending from the cover has to be interrupted for permitting the contact extension to extend through the partition, thereby breaking the insulation locally between the electromagnet and the contact block.

SUMMARY OF THE INVENTION

In view of the above, the present invention has been accomplished to further improve the double-wall insulation between the electromagnet and the contact block. The relay in accordance with the present invention comprises a base provided with an insulation enclosure made of an electrically insulative material and having a longitudinal axis. The insulation enclosure is opened at its opposite longitudinal ends to have a front opening and a rear opening, and comprises a top wall, side walls, and a bottom wall which are contiguous along the length of and around the periphery of the enclosure, respectively to form a tunnel therein. Mounted on the base outwardly of the side wall of the insulation enclosure is a contact block which comprises at least one pair of a movable contact and a fixed contact. An electromagnet block is received within the enclosure through the rear opening thereof and comprises a coil, yokes, and an armature extending through the coil along the length of the enclosure. The armature is magnetically coupled to the coil so as to move relative to the yokes upon energization of the coil. Bridging between the armature and the movable contact of the contact block is a card of an electrically insulative material for transmitting the armature movement to open and close the movable and fixed contacts. A cover of electrically insulative material fits around the base to encase the contact block, the electromagnet block, and the card between the cover and the base. The cover is formed with at least one insulation partition which depends from a top wall of the cover to extend between the insulation enclosure and the contact block for realizing a double-wall insulation between the electromagnet and the contact block. The card comprises a trunk for connection with the armature and a crosspiece for connection with the movable contact at a portion outward of the insulation enclosure and the insulation partition.

The features of the present invention reside in that the trunk extends into the insulation enclosure through the front opening thereof to fit around the longitudinal end of the armature such that the entire length of the armature is insulated from the contact block by the top wall, the side wall and the bottom wall of the enclosure and by the trunk, that the crosspiece extends from the trunk longitudinal outwardly of the insulation enclosure in a transverse relation to the length of the insulation enclosure for connection with the movable contact outwardly of the insulation enclosure and partition, and that the insulation partition is contiguous along substantially the entire length of the insulation enclosure. With these features, the relay can have an improved double-wall insulation between the electromagnet block and the contact block without leaving any insulation break along the length of the electromagnet block, in addition to that the armature of the electromagnet can be spaced by a great creeping distance from the adjacent contact assembly.

Accordingly, it is a primary object of the present invention to provide an electromagnetic relay which is capable of maximizing the insulation between the electromagnet and the contact block.

In a preferred embodiment, the insulation partition has its front end projecting longitudinally outwardly of the insulation enclosure in an overlapping relation to the trunk of the card. Thus, the longitudinal end of the armature can be insulated from the contact block by the trunk of the card itself and by at least the insulation partition for provide sufficient insulation between the armature of the electromagnet block and the contact block, which is therefore another object of the present invention.

The base may be formed with a groove which extends along the wall of the insulation enclosure for receiving the lower end of the insulation partition. Thus, the insulation partition can be easily fitted to the base when the cover is placed on the base, thereby facilitating the assembly of the relay.

The insulation enclosure has a width defined as a dimension between the outer surfaces of the side walls of the enclosure. The width is made narrower towards the front opening than at the rear opening to give a space outwardly of the front end of the enclosure available for the contact block, therefore assuring a compact design. In addition, the insulation partition fits closely over the side walls of the enclosure so that the partition acts to reinforce the enclosure to give a rugged insulation structure against a shock or the like external force which may be applied to the relay in use.

The side wall of the insulation enclosure is formed with at least one step by which the width of the enclosure is narrower in a stepped manner towards the front opening. With the presence of the step, the enclosure can be itself reinforced to give a sufficient mechanical strength against torsion or bend which may be applied to the enclosure, thereby assuring dimensional stability and therefore exact positioning of the electromagnet relative to the card for reliable operation.

In the preferred embodiment, the contact block is mounted on either side of the insulation enclosure. The card is in the form of a generally T-shaped configuration with the trunk and the crosspiece which is connected at its opposite ends respectively to the movable contacts longitudinally and laterally outwardly of the insulation enclosure and the insulation partition.

In another embodiment, the base comprises a first sub-base and a second sub-base which are molded separately from each other. The first sub-base carries the movable and fixed contacts which are molded-in into the first sub-base, and the second sub-base is molded integrally with the insulation enclosure. With this configuration, it is possible that the base can have the insulation enclosure opened opposite ends and at the same time the molded-in movable and fixed contacts, yet the individual sub-bases can be easily molded into a desired shape. In order to assemble the sub-bases, the second sub-base is formed with anchor studs which are fitted into corresponding holes in the first sub-base and are riveted by an application of heat to the first sub-base. Alternately, the anchor stud may be formed on the first sub-base for insertion into the corresponding hole formed in the second sub-base.

When the anchor studs are formed in the second sub-base integral with the insulation enclosure, it is preferred that the electromagnet is received in the enclosure with the bottom of the yokes being pressed against the bottom wall of the enclosure at such portions that the yokes bear a force applied when the anchor studs are riveted to the first sub-base. Thus, the riveting can be made easily without damaging the enclosure by best utilizing the yokes as a supporting member for a punch utilized for riveting the studs.

In a further embodiment, the base comprises a first sub-base, a second sub-base, and third sub-base which are molded separately from each other. Each of the first and second sub-bases carries the molded-in movable contact and the fixed contact. The third sub-base is molded to have the insulation enclosure integrally therewith.

In a still further embodiment, the base comprises a first sub-base and a second sub-base which are molded separately from each other. Each of the first and second sub-bases carries the pair of the molded-in movable and fixed contacts, and is molded to have integral halves which are cooperative to form the insulation enclosure. The integral halves act as reinforcing ribs for the individual sub-bases to give an increased resistance against bending or warp.

Preferably, the insulation enclosure is molded separately from the base and is assembled on the base with the bottom wall of the insulation enclosure placed upon the base. The bottom wall of the insulation enclosure is cut away at its rear end to define thereat a notch into which a raised rim at the rear end of the base fitted. The electromagnet block includes a coil bobbin for winding the coil therearound. The coil bobbin has a rear end of which lower end abuts against the raised rim of the base such that a sealing agent filled through between the case and the base can reach a portion between the coil bobbin and the base. Thus, the coil bobbin can be also secured to the base by the use of the sealing agent.

The coil bobbin has a longitudinal axis and is formed at its opposite axial ends with end flanges, while each of the yokes is of a generally U-shaped configuration with a horizontal member and a pair of vertical members extending from the opposite ends of a horizontal member. The yokes are fitted over the coil bobbin with the vertical members engaged with outer surfaces of the end flanges and are spaced laterally to define between the opposed vertical members gaps in which the armature extends. The coil bobbin includes front and rear extensions which project respectively longitudinally outwardly of the end flanges and are formed with positioning slots through which the vertical members of the yokes extend snugly. Thus, the yokes can be exactly positioned on the coil bobbin. One of the end flanges may be formed with a positioning projection which engages with at least one of the yokes for preventing the yoke from tilting.

The coil bobbin is formed with a bottom slot into which a permanent magnet is press-fitted in a closely adjacent relation to the horizontal members of the yokes so that the yokes are magnetized to the opposite polarity. Thus, the permanent magnet necessary for a bistable relay operation can be easily held in place without requiring direct contact with the yokes, keeping the accurate positioning of the yoke to the coil bobbin.

These and still other objects and advantageous features will become more apparent from the following description of the preferred embodiments when taken in conjunction with the attached drawings.

BRIEF DESCRIPTION OF THE DRAWINGS

FIG. 7 is an elevation of the above relay with a cover removed therefrom;

FIG. 8 is an exploded perspective view of a base and an insulation enclosure of the above relay;

DETAILED DESCRIPTION OF THE EMBODIMENTS

First Embodiment <FIGS. 1 to 5>

Figure 1:
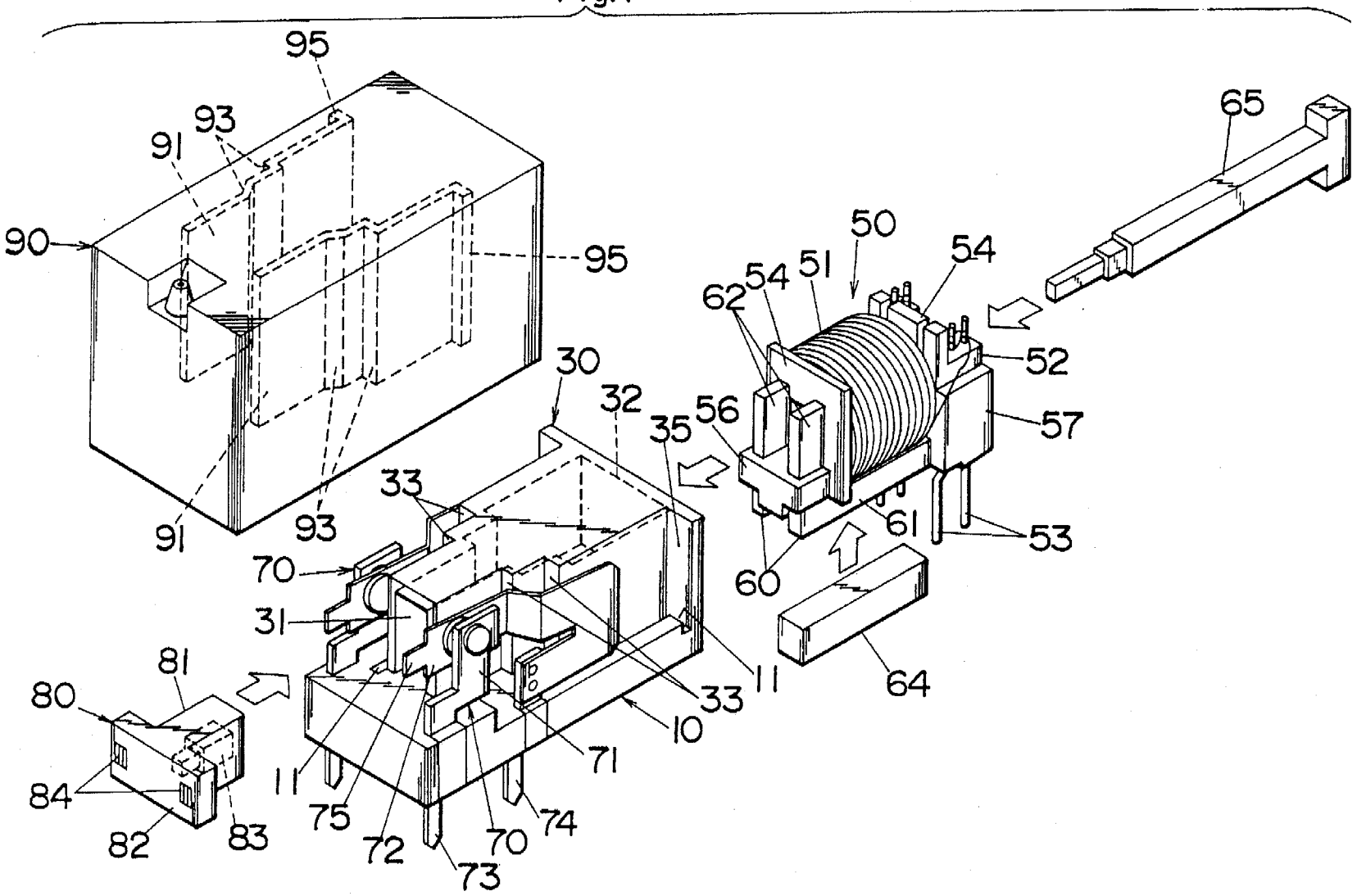
FIG. 1 is an exploded perspective view of an electromagnetic relay in accordance with a first embodiment of the present invention.

Referring now to FIG. 1, there is shown an electromagnetic relay in accordance with a first embodiment of the present invention. The relay comprises an elongated rectangular base 10 made of an electrically insulative plastic material mounting thereon an electromagnet block 50 and a pair of contact blocks 70, and a rectangular cover 90 also made of electrically insulative plastic material fitted on the base 10 to encase therebetween the electromagnet and the contact blocks. The base 10 is molded to have an integral insulation enclosure 30 which receives therein the electromagnet block 50 for electrically insulating it from the contact block 70.

The insulation enclosure 30 is elongated along the length of the base 10 and comprises a bottom wall common to the base, a top wall, and side walls which are contiguous along the entire length of the enclosure and define therein a tunnel which is opened only at a front opening 31 and a rear opening 32. The enclosure 30 is configured to have a width which is narrower towards the front opening 31 than at the rear opening 32 to leave outwardly of the front portion of the enclosure spaces for mounting the contact blocks 70. The width of the enclosure is defined as a dimension between the outer surfaces of the opposed side walls. The side walls are respectively formed with steps 33 by which the width of the enclosure 30 is made narrower towards the front opening 31.

The contact block 70 comprises a fixed contact 71 and a movable contact 72 which are mounted on the base 10 and having respective terminals 73 and 74 extending downwardly of the base 10. The movable contact 72 is made of a generally U-shaped spring with one end secured to the terminal and with the other end held in an engageable relation to the fixed contact 71. The movable contact 72 has a forward projection 75 which is connected to receive a driving force of opening and closing the contacts.

The electromagnet block 50 comprises a pair of set and reset coils 51 wound around a coil bobbin 52 between end flanges 54 of the bobbin and connected respectively to coil terminals 53. These two coils 51 are turned in the opposite direction and are energized by a current supplied across the respective pairs of coil terminals 53. The coil bobbin 52 carries a spaced pair of generally U-shaped yokes 60 each composed with a horizontal member 61 and a pair of vertical members 62 extending upwardly from the opposite ends of the horizontal member 61. The vertical members 62 extend respectively through a front extension 56 and a rear extension 57 of the coil bobbin 52 to define pole ends longitudinally outwardly of the end flanges 54.

Figure 2:
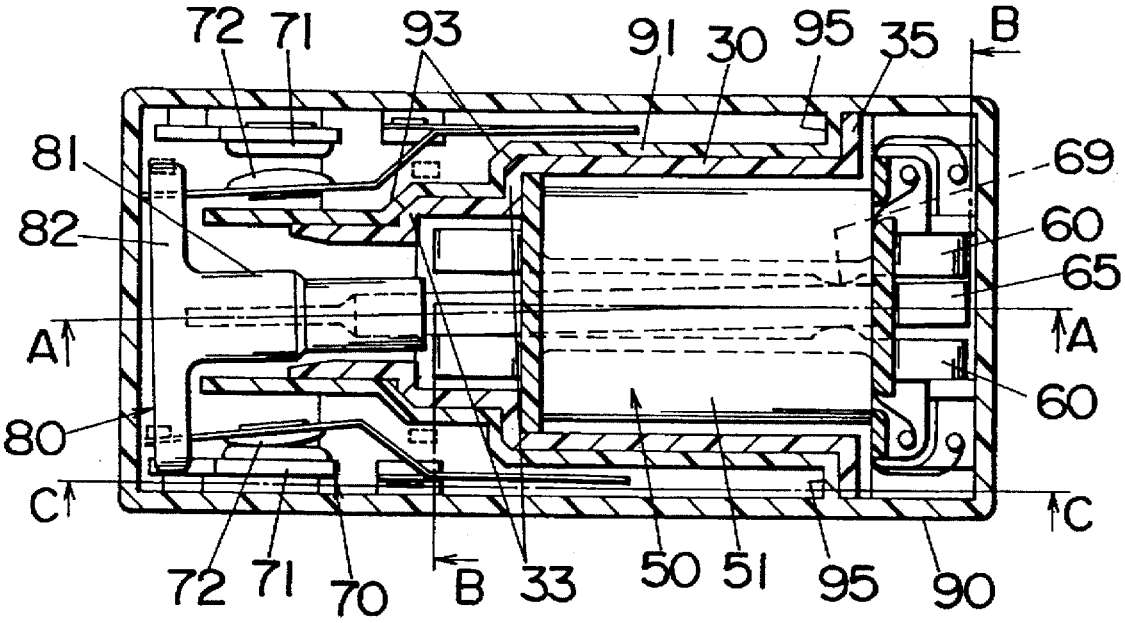
FIG. 2 is a horizontal section of the above relay.
Figure 3:
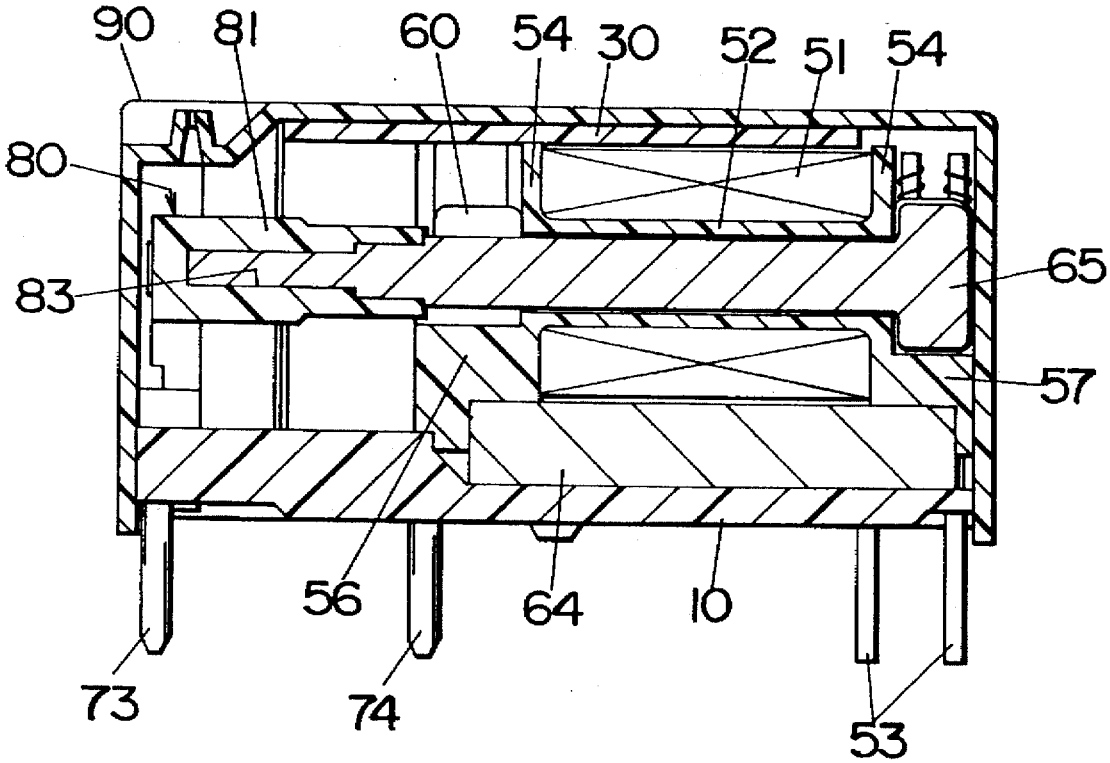
FIG. 3 is a cross section taken along line A—A of FIG. 2.
Figure 4:
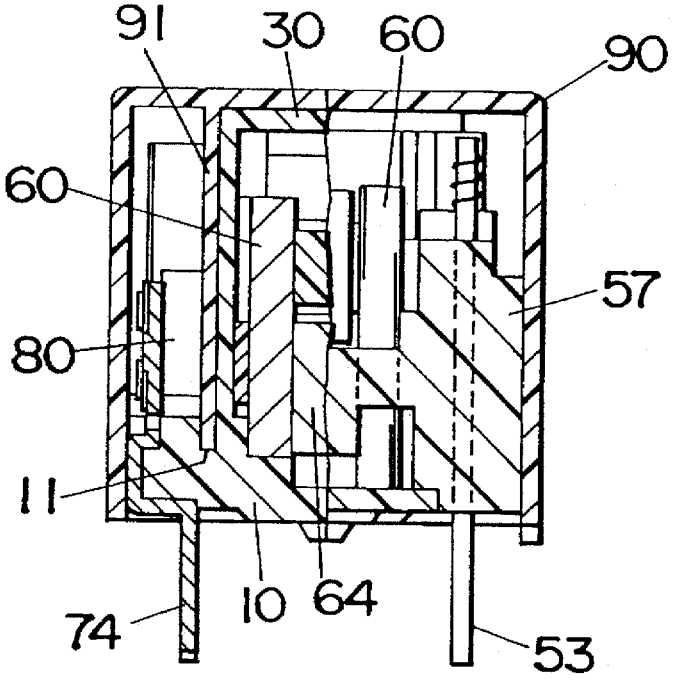
FIG. 4 is a cross section taken along line B—B of FIG. 2.
Figure 5:
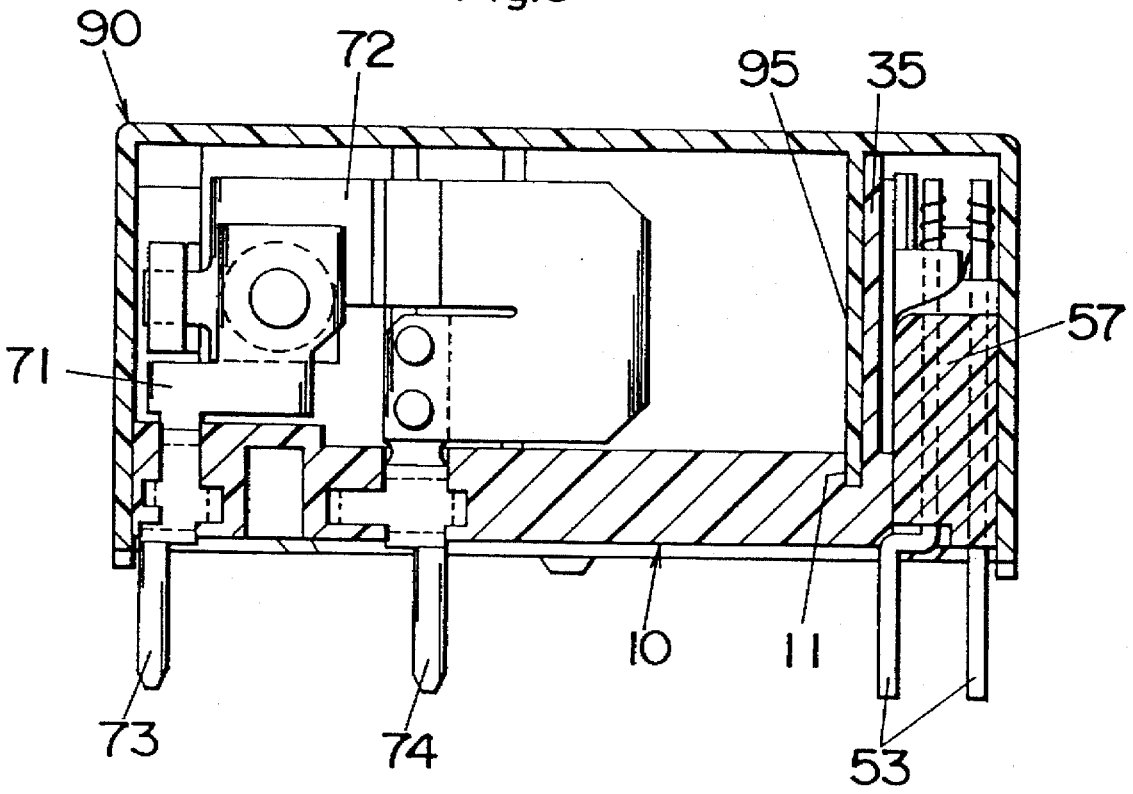
FIG. 5 is a cross section taken along line C—C of FIG. 2.

A permanent magnet 64 is disposed between the horizontal members of the yokes 60 to magnetize the yokes to the opposite polarity. Also included in the electromagnet block 50 is an armature 65 which, as shown in FIG. 2, extends through the coil bobbin between the pole ends, i.e., the vertical members 62 of the laterally spaced yokes 60. The armature 65 is pivotally supported at a point 69 adjacent its rear end to the coil bobbin 52 so that the armature 65 is movable between two stable positions where the armature 65 has its front portion attracted to the pole end, i.e., vertical member 62 of one yoke 60 and attracted to the pole end 62 of the other yoke 60. The movement of the armature 65 is transmitted through a card 80 to open and close the contacts. When one of the coils 51 is energized by a current of a given polarity, the armature 65 has its front end attracted to one of the pole ends 62 to close the contacts of the first contact block 70 and opens the contacts of the second contact block 70, as shown in FIG. 2. The armature 65 is held stable at this condition until the other coil is energized to attract the armature 65 to close the contacts of the second contact block 70 and open the contacts of the first contact block 70.

The card 80 is molded from an electrically insulative plastic material into a generally T-shaped configuration with a trunk 81 and a crosspiece 82 extending transversely from the trunk 81. The trunk 81 is formed with a stepped hole 83 into which a correspondingly stepped front end of the armature 65 projects snugly for connection of the card 80 with the armature 65. The crosspiece 82 is formed at its opposite ends with slots 84 into which the projections 75 of the movable contacts 72 fit for connection of the card 80 with the movable contacts 72. As shown in FIG. 2, the trunk 81 projects into the enclosure 30 through the front opening 31 thereof to surround or insulate the front end of the armature 65. Thus, the armature 65 is insulated along its entire length from the contact block, particularly the movable contacts 72 by the enclosure 30 and the trunk 81 of the card 80. An adhesive may be filled in the hole 83 to secure the front end of the armature 65 to the card 80.

The cover 90 is formed with a pair of integrally molded partitions 91 which depend from an inner top surface of the cover to fit closely over the side walls of the enclosure 30. The partition 91 extends contiguously over the full length of the enclosure 30 with a front end thereof projecting beyond the enclosure 30 to a point immediately adjacent the crosspiece 82 of the card 80, as shown in FIG. 2, thus providing a double-wall insulation by which the electromagnet block 50 including the armature 65 is insulated along the full length thereof from the contact block 70.

The lower end of the partition 91 is anchored into a groove 11 formed in the base 10 along the outer surface of the side wall of the enclosure 30. The groove 11 extends along the full length of the side wall of the enclosure 30 and further extends along a rim 35 which projects laterally from the rear end of the enclosure 30 and terminates at the side edge of the rectangular base 10, as shown in FIG. 1. Projecting into the groove 11 adjacent the rim 35 is a rib 95 which extends from the rear end of the partition 91 to the inner wall of the cover 90. With the presence of the rib 95 and steps 93 provided in conformity with the steps 33 of the enclosure 30, the partition 91 is strengthened. Further, the close fitting of the partition 91 over the enclosure 30 can strengthen the relay structure against bending, twisting or the like which may be applied during the use.

Second Embodiment <FIGS. 6 to 15>

Figure 6:
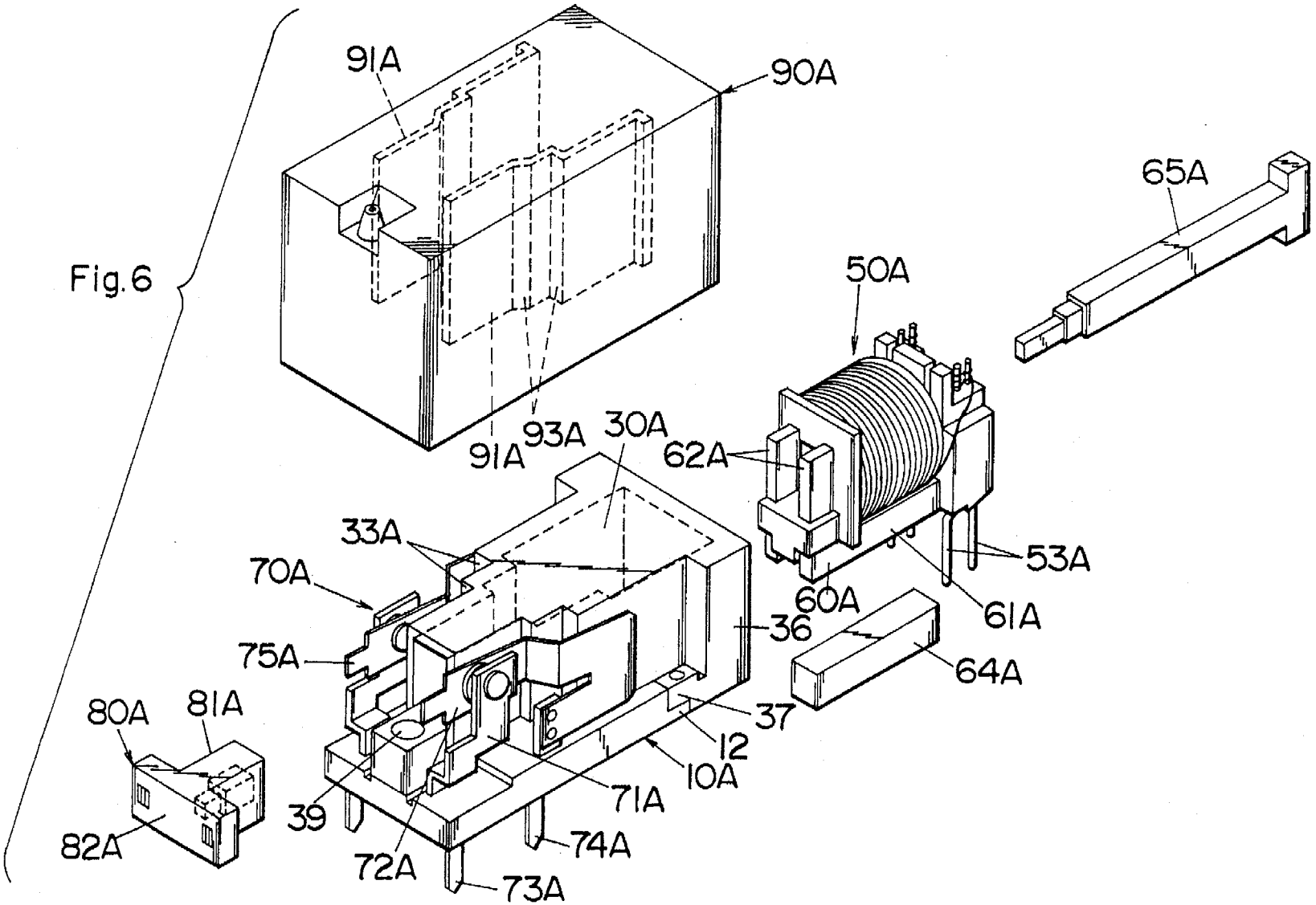
FIG. 6 is an exploded perspective view of an electromagnetic relay in accordance with a second embodiment of the present invention.
Figure 9:
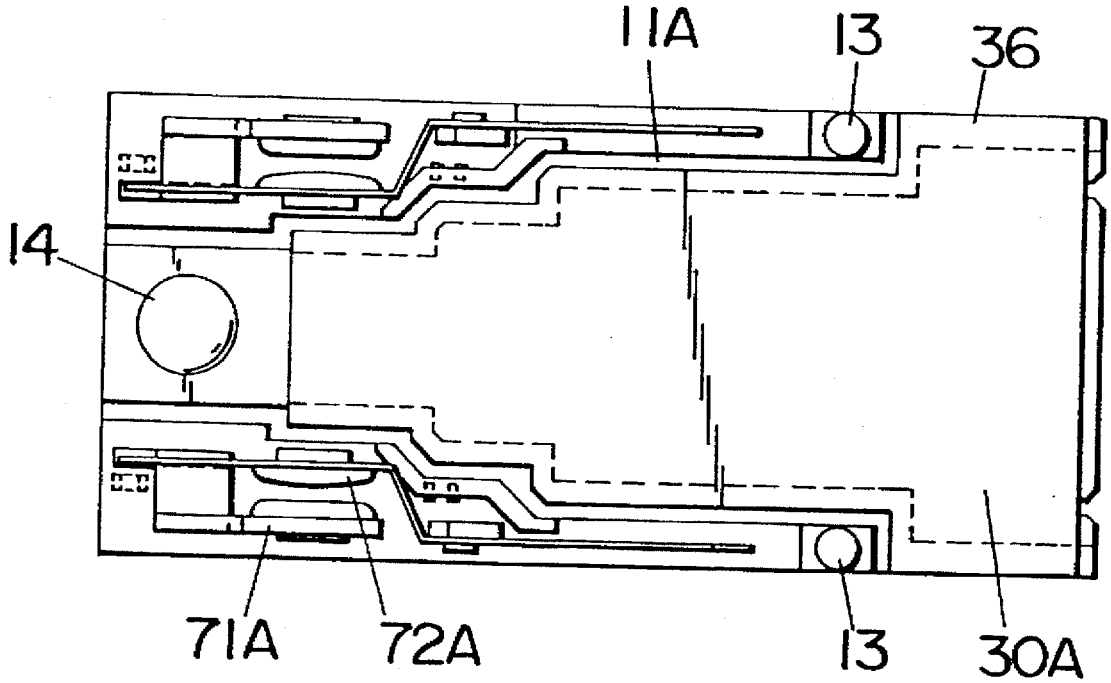
FIG. 9 is a top view of the above relay without the cover.
Figure 10:
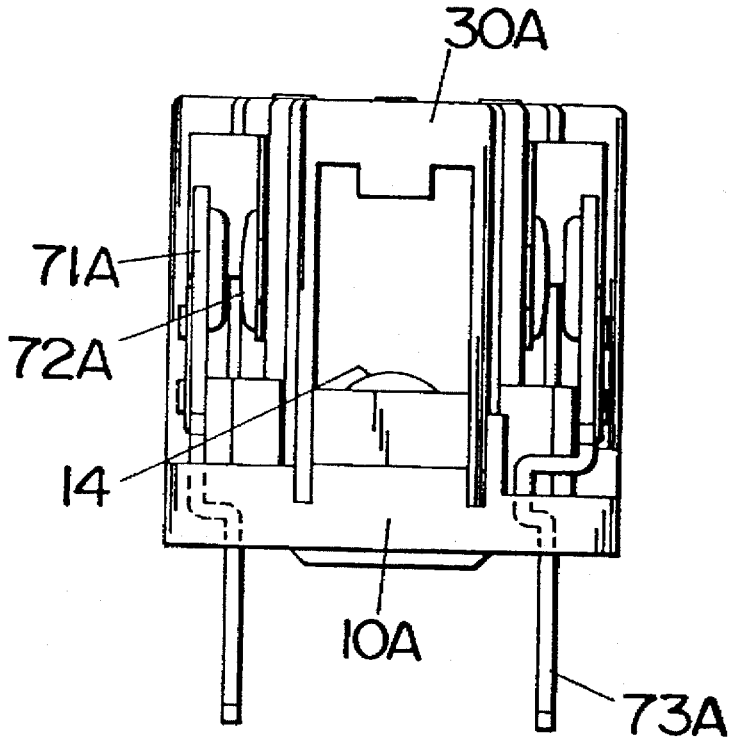
FIG. 10 is an end view of the above relay without the cover.
Figure 11:
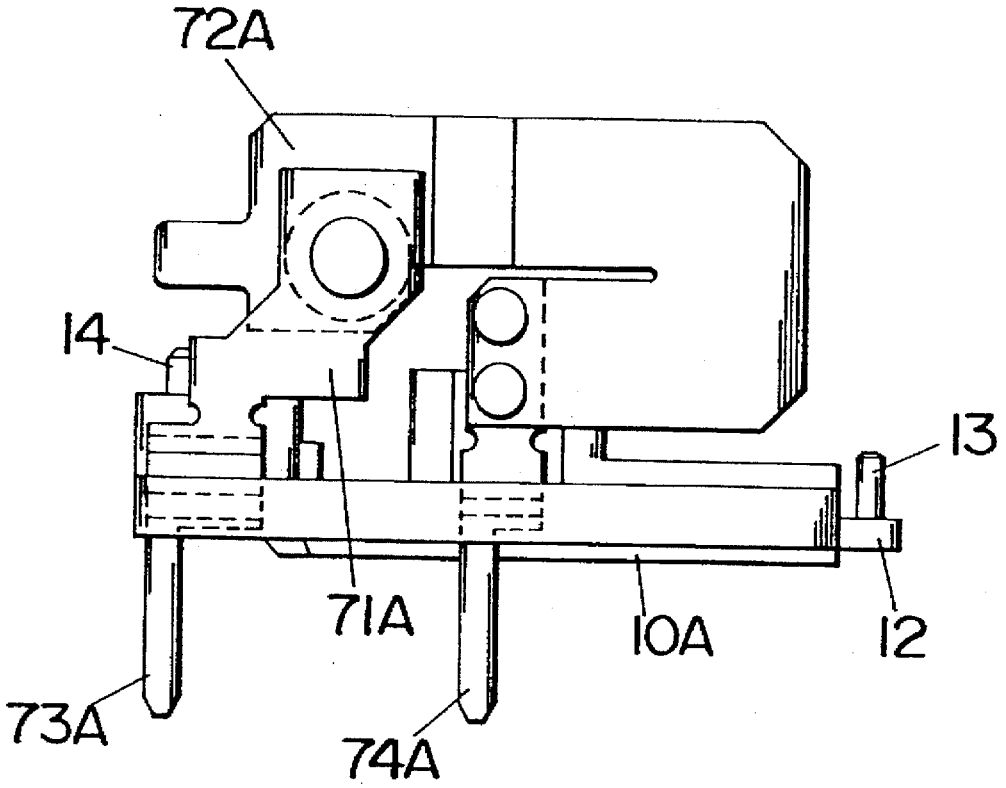
FIG. 11 is an elevation of a base with molded-in contacts constituting the above relay.
Figure 12:
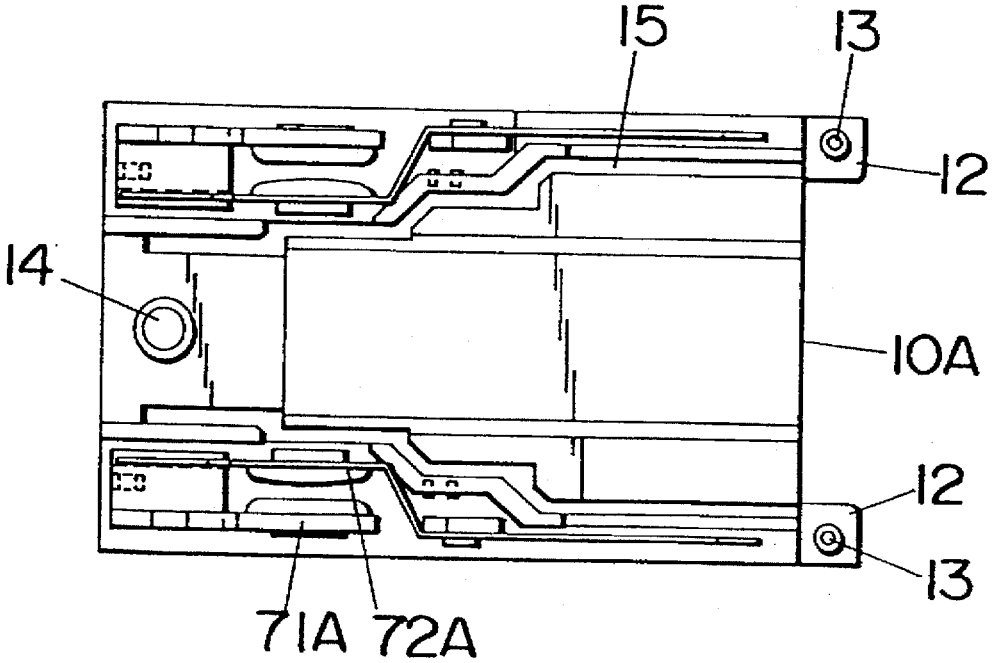
FIG. 12 is a top view of the above base.
Figure 13:
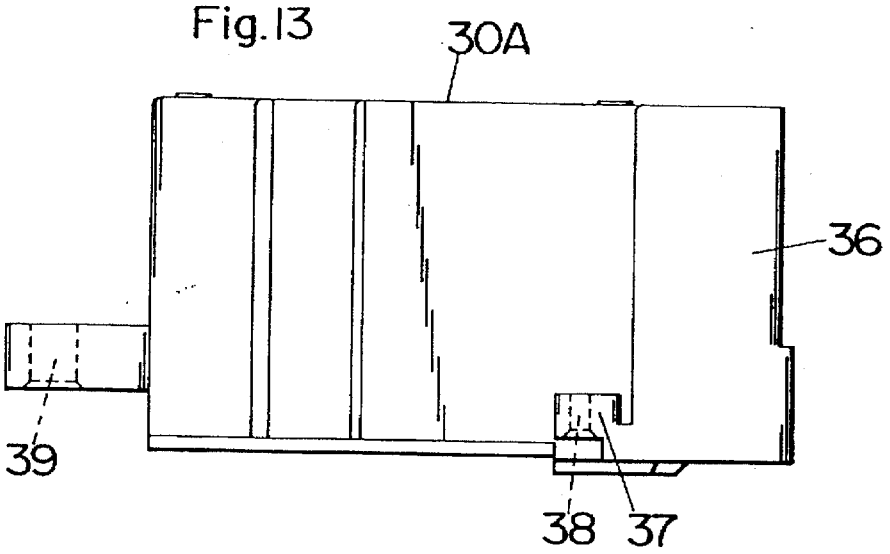
FIG. 13 is an elevation of an insulation enclosure placed upon the above base.
Figure 14:
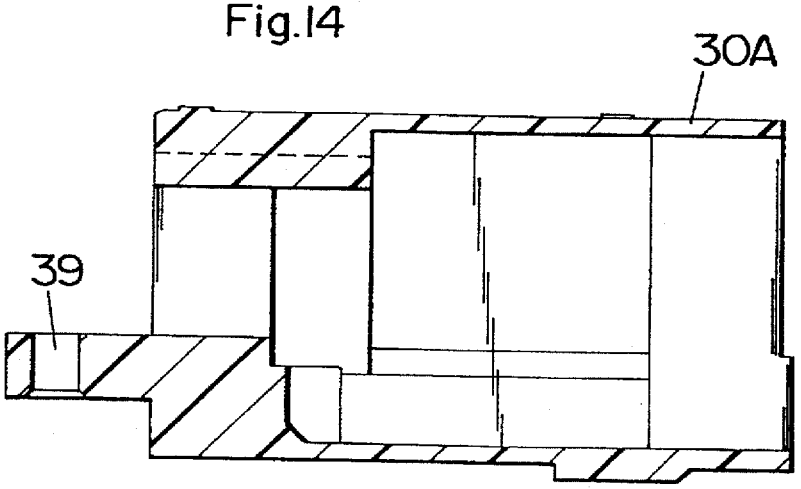
FIG. 14 is a longitudinal section of the above enclosure.
Figure 15:
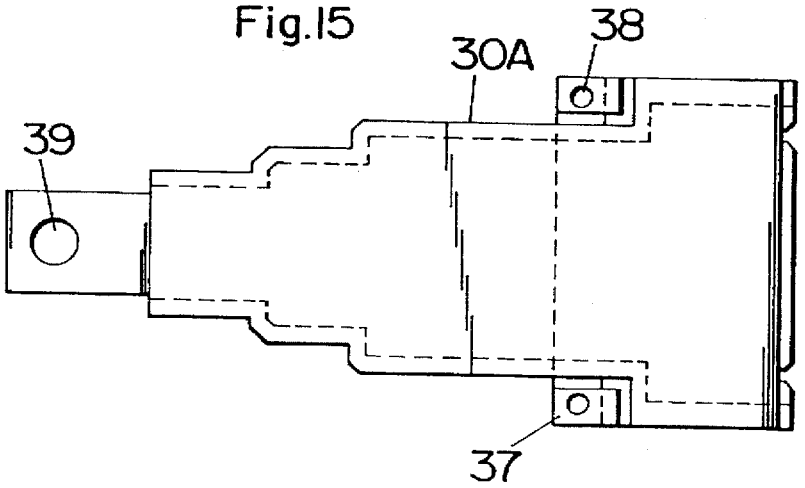
FIG. 15 is a top view of the enclosure.

FIG. 6 illustrates an electromagnetic relay in accordance with a second embodiment of the present invention which is similar to the first embodiment except that an enclosure 30A is molded separately from a base 10A. Like parts are designated by like numerals with a suffix letter of "A". Fixed contacts 71A and movable contacts 72A are respectively molded-in into the base 10A to be exactly positioned on the base 10A. The enclosure 30A is formed at its rear end with an sub-base 36 which is secured to the rear end of the base 10A. To this end, tongues 12 project from the rear end of the base 10A for engagement with a corresponding tongues 37 projecting from the sub-base 36 as shown in FIGS. 7 and 8. The tongues 12 are formed with integral studs 13 which project through corresponding holes 38 in the tongues 37 and are riveted thereto by the application of heat. Likewise, a stud 14 on the front end of the base 10A projects into a corresponding hole 39 in a front nose extending integrally from the enclosure and is riveted thereto. With the separate molding of the enclosure 30A and the base 10A, the contacts can be molded-in into the base, while the enclosure 30A can be successfully molded to have a complicated configuration as desired. In this embodiment, the groove 11A into which the lower end of the partition 91A fits comprises a first groove 15 formed in the base 10A and a second groove 16 formed in the sub-base 36 of the enclosure 30A.

Figure 17:
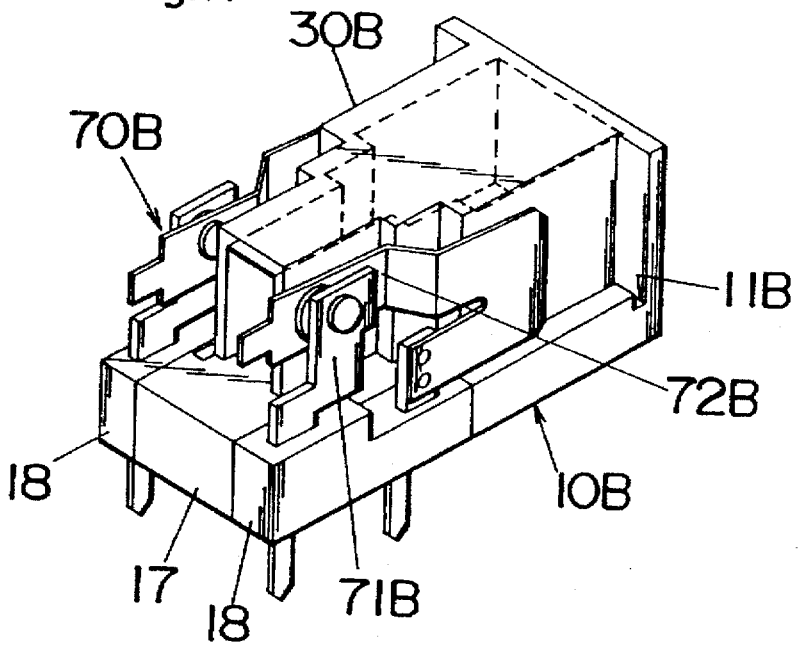
FIG. 17 is a perspective view of the above relay without the cover.
Figure 16:
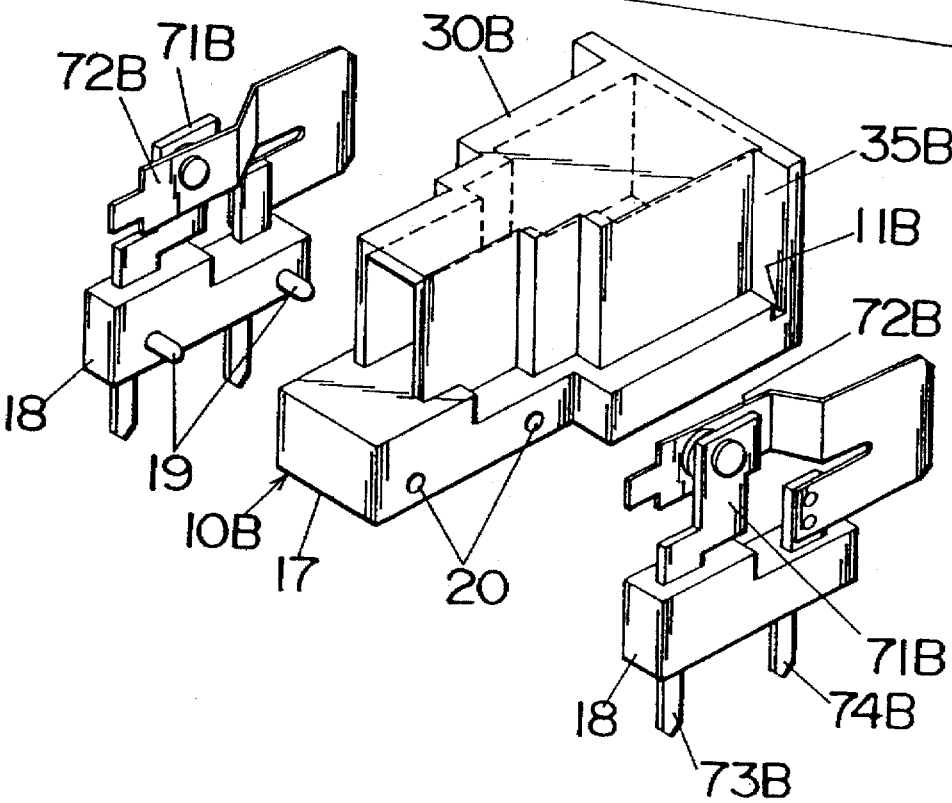
FIG. 16 is an exploded perspective view of an electromagnetic relay in accordance with a third embodiment of the present invention shown with a cover being removed therefrom.

Third Embodiment <FIGS. 16 and 17>

FIGS. 16 and 17 illustrate an electromagnetic relay in accordance with a third embodiment of the present invention which is similar to the first embodiment except that a base 10B is assembled from a center sub-body 17 and a pair of outer sub-bodies 18 which are molded separately from one another. Like parts are designated by like numerals with a suffix letter of "B". The center sub-body 17 is formed integrally with a like enclosure 30B, while the outer sub-bodies 18 is formed with molded-in fixed contacts 71B and movable contacts 72B. The outer sub-bodies 17 are provided with studs 19 which are inserted into corresponding holes 20 in the center sub-base 17 for securing the outer sub-bodies to the center sub-body 17.

Figure 18:
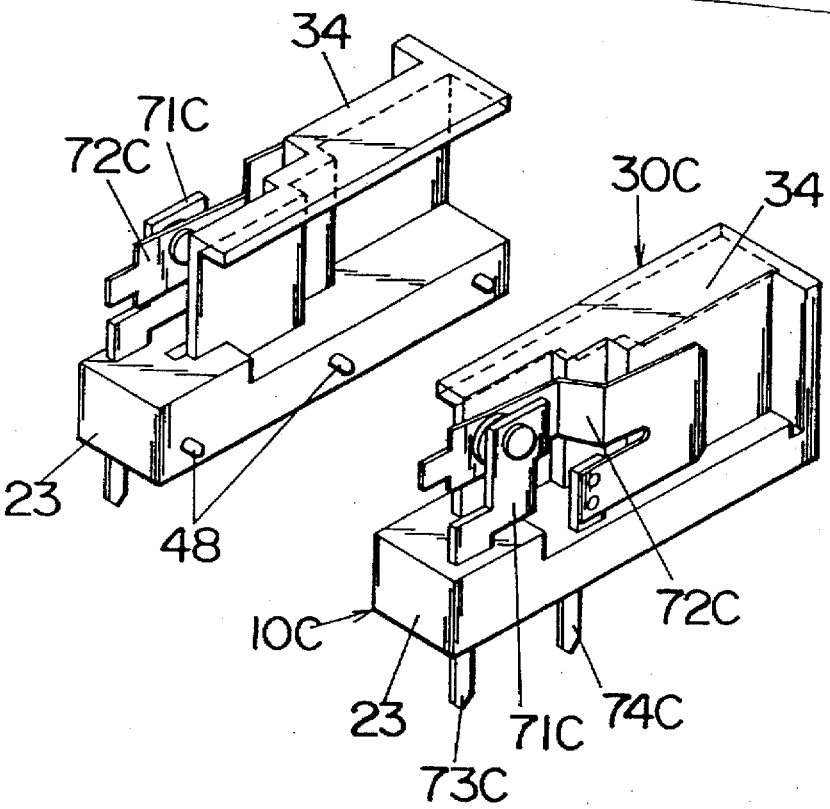
FIG. 18 is an exploded perspective view of an electromagnetic relay in accordance with a fourth embodiment of the present invention shown
Figure 19:
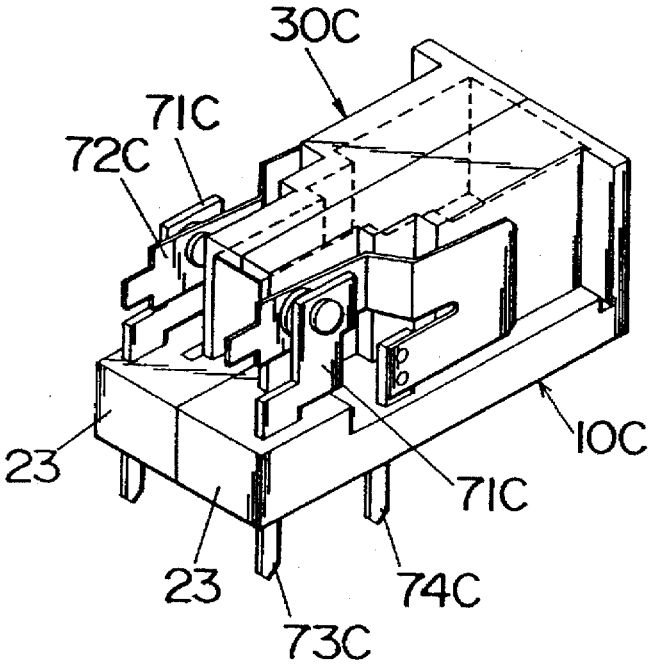
FIG. 19 is a perspective view of the above relay without the cover.

Fourth Embodiment <FIGS. 18 and 19>

FIGS. 18 and 19 illustrate an electromagnetic relay in accordance with a fourth embodiment of the present invention which is similar to the first embodiment except that a base 10C comprises a pair of sub-bases 23 each molded to have integral halves 34 which are cooperative to constitute a like enclosure 30C. Like parts are designated by like numerals with a suffix letter of "C". The sub-bases 23 is formed to have molded-in fixed contacts 71C and movable contacts 72C. One of the sub-bases 23 are provided with studs 48 which are inserted into corresponding holes (not shown) in the other sub-base 23 for securing the sub-bases together.

Fifth Embodiment <FIGS. 20 to 37>

Figure 20:
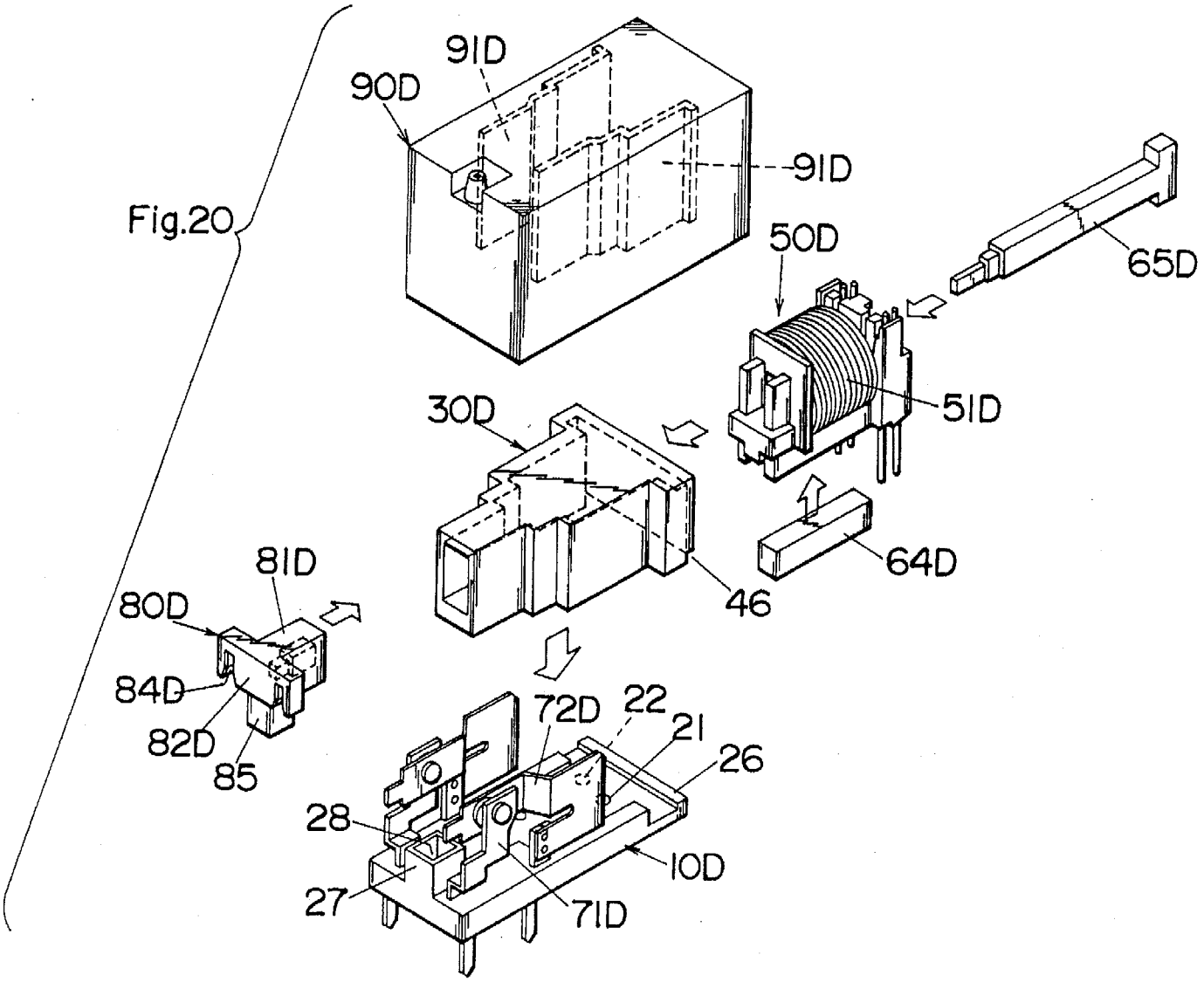
FIG. 20 is an exploded perspective view of an electromagnetic relay in accordance with a fifth embodiment of the present invention.
Figure 21:
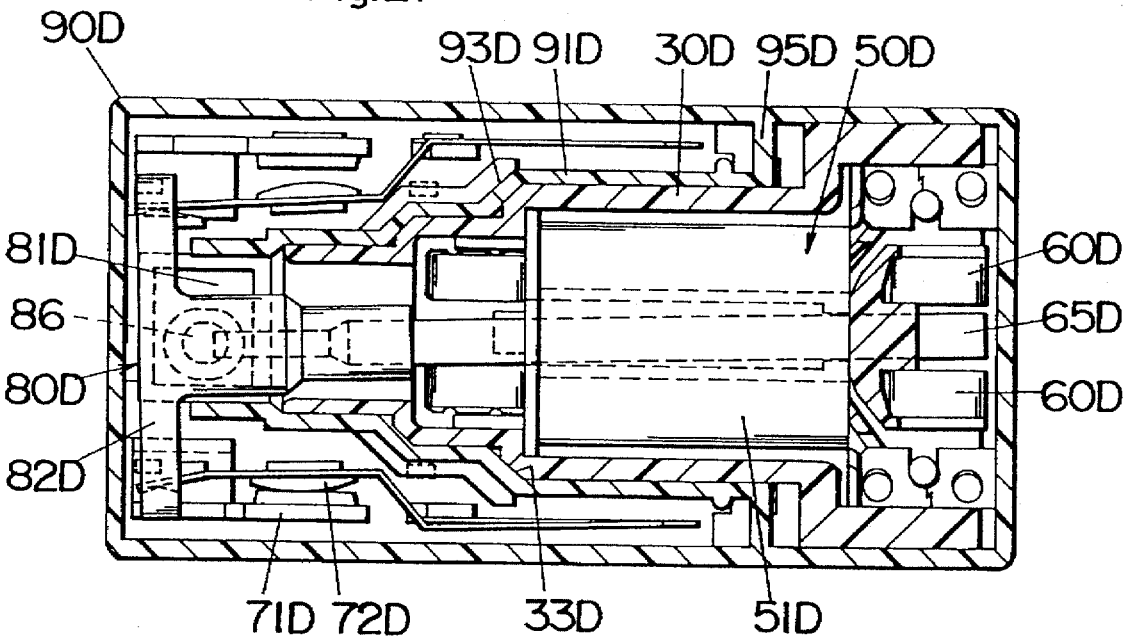
FIG. 21 is a horizontal section of the above relay.
Figure 25:
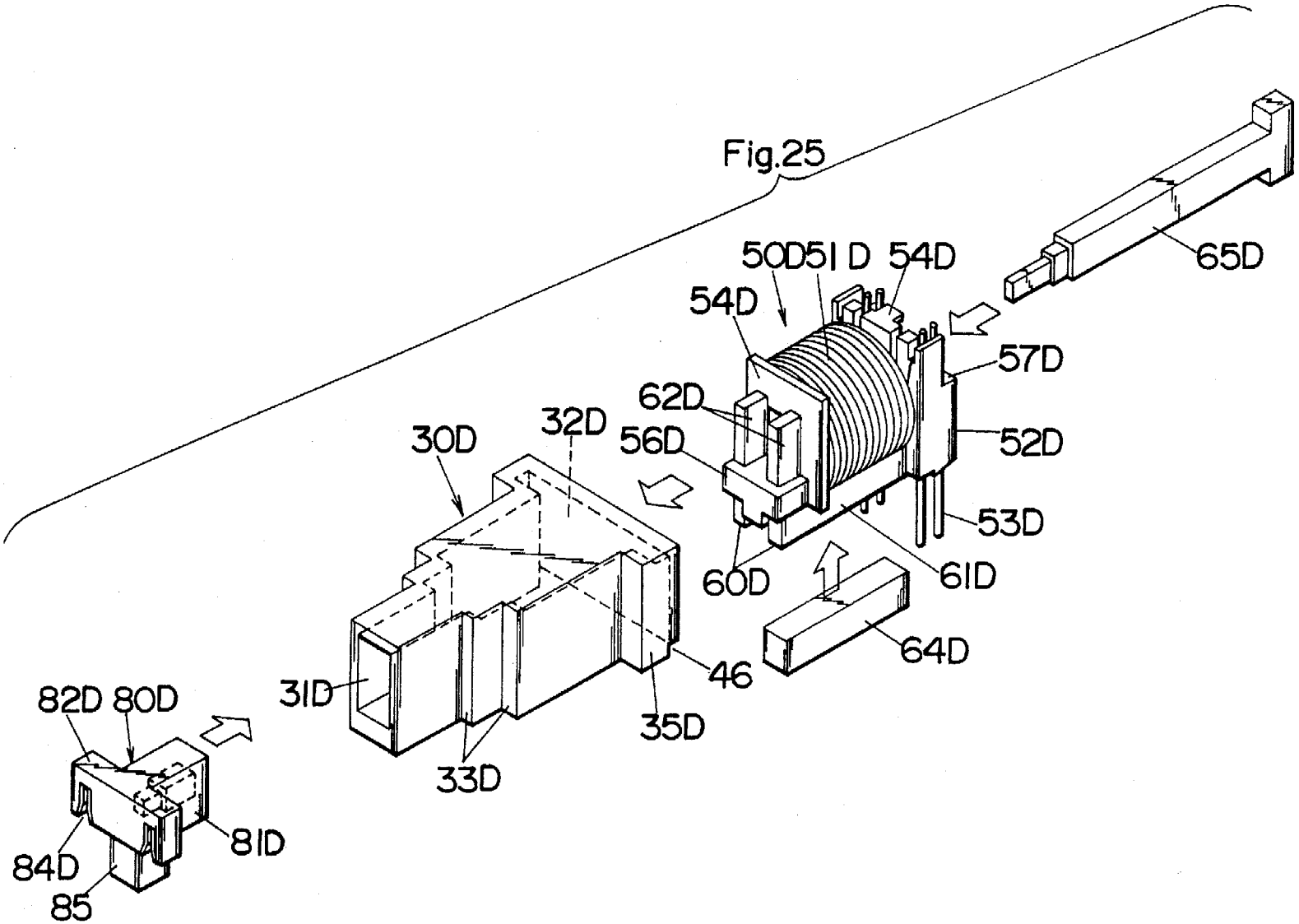
FIG. 25 is an exploded perspective view illustrating an armature, an electromagnet with a permanent magnet, an insulation enclosure and a card which are assemble on a base of the above relay.

FIG. 20 illustrates an electromagnetic relay in accordance with a fifth embodiment of the present invention which is similar to the first embodiment except that a base 10D is molded separated from a like enclosure 30D and to have fixed contacts 71D and movable contacts 72D molded-in into the base 10D. Like parts are designated by like numerals with a suffix letter of "D". The enclosure 30D is formed by injection-molding into a tubular configuration with a top wall, side walls, and a bottom wall. The side walls are formed with steps 33D by which the width of the enclosure 30D is made smaller towards a front opening 31D than at a rear opening 32D of the enclosure 30D as is seen in the first embodiment. As seen in FIG. 25, a like electromagnet block 50D is assembled into the enclosure 30D through the rear opening 32D, while a card 80D is connected to the front end of an armature 65D with a trunk 81D being inserted into the enclosure 30D through the front opening 31D thereof.

Figure 24:
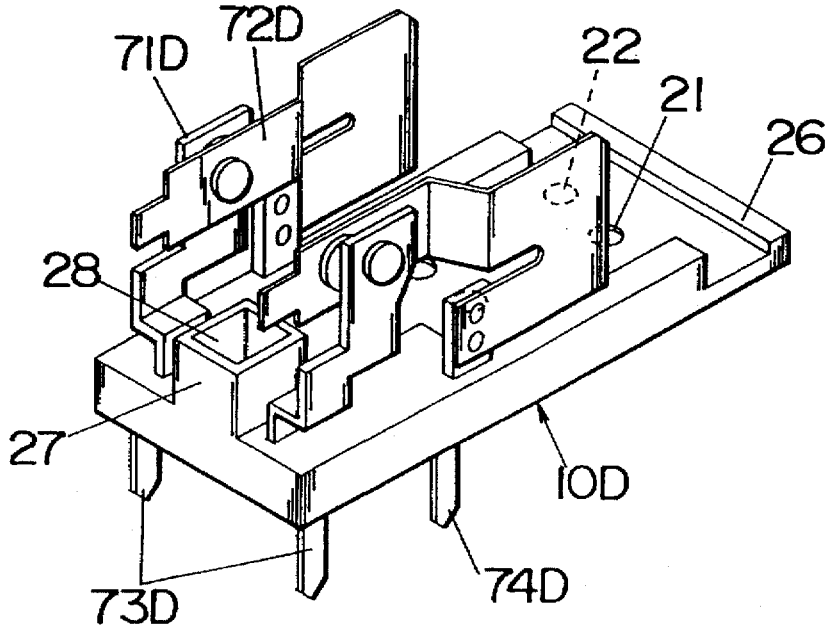
FIG. 24 is a perspective view of a base with molded-in contacts constituting the above relay.
Figure 26:
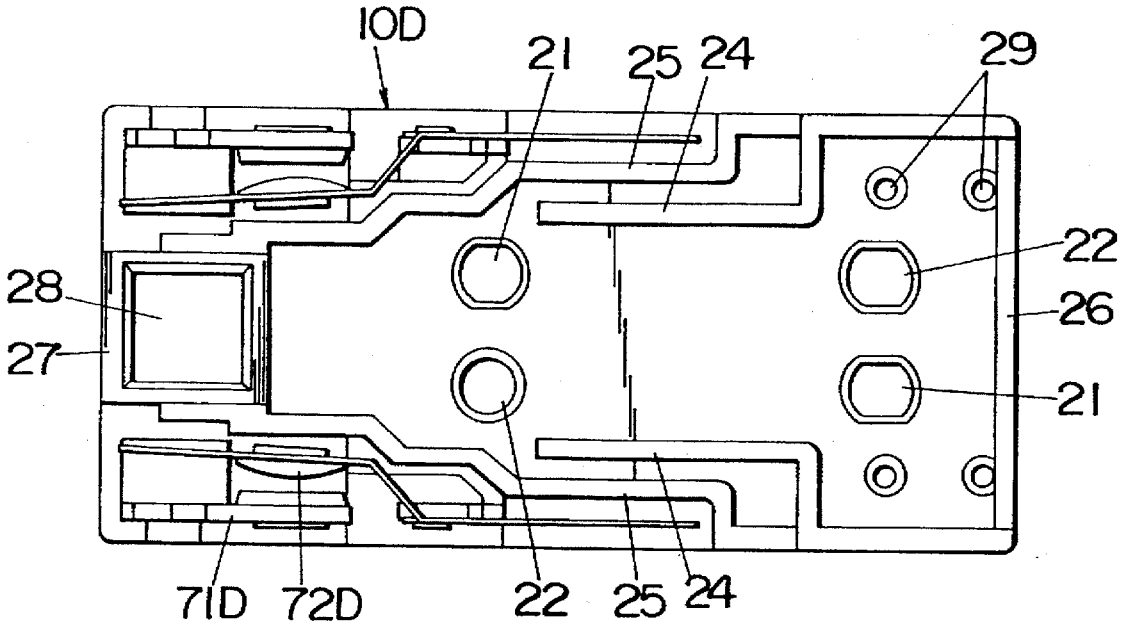
FIG. 26 is a plan view of the above base.
Figure 29:
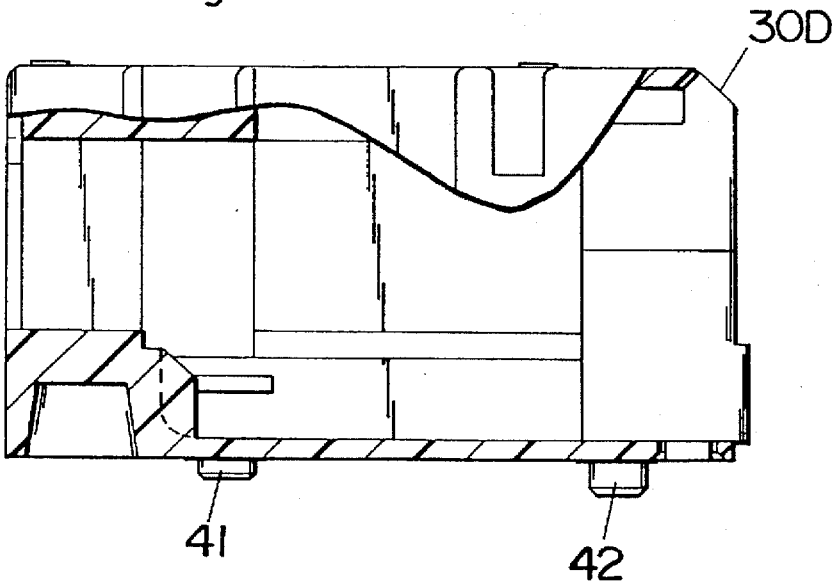
FIG. 29 is a vertical section partly in elevation of the insulation enclosure.
Figure 30:
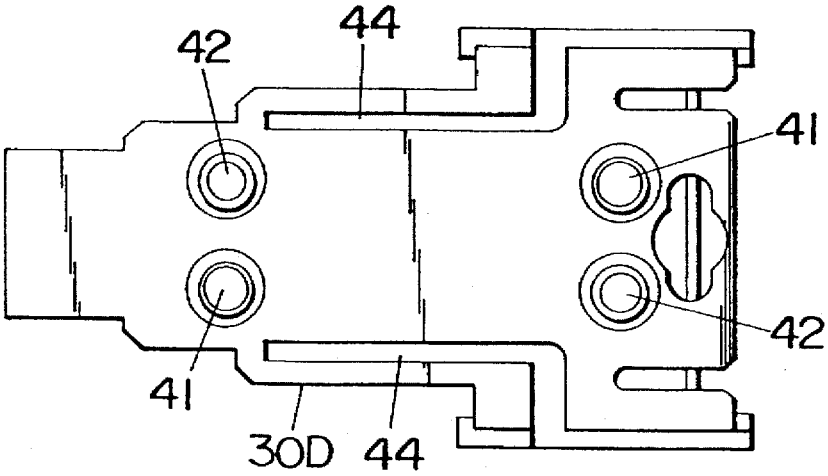
FIG. 30 is a bottom view of the insulation enclosure.
Figure 31:
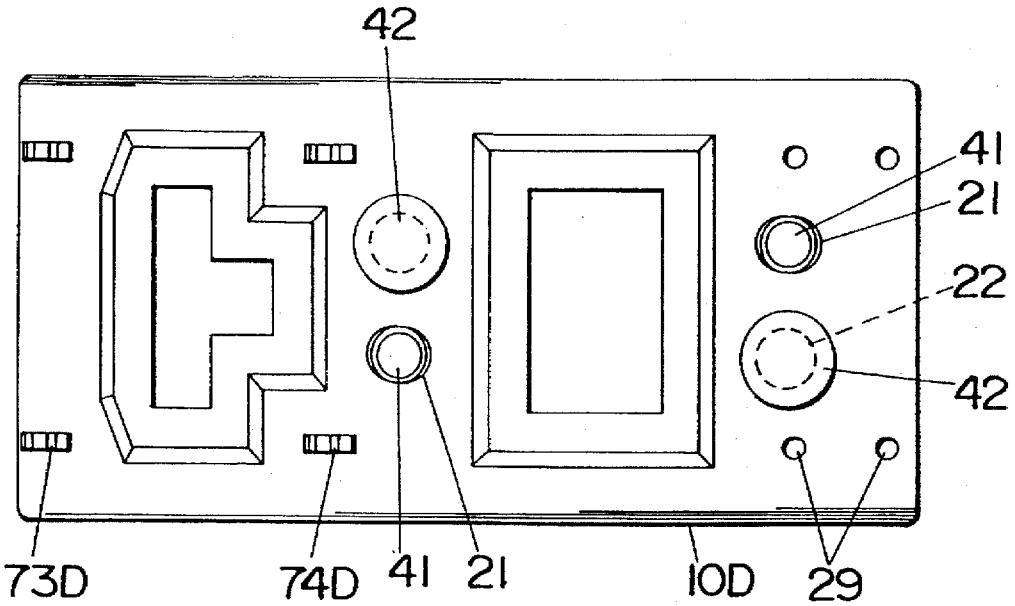
FIG. 31 is a bottom view of the base.
Figure 32:
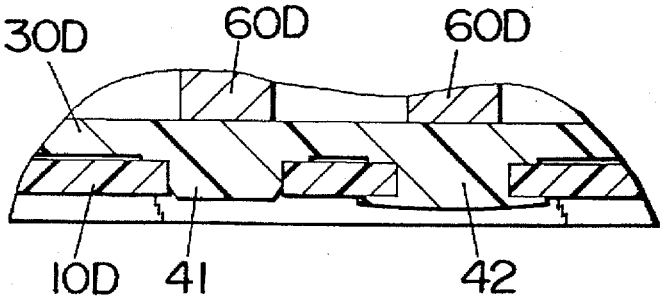
FIG. 32 is a partial sectional view illustrating a rivet connection between the base and the insulation enclosure.

As shown in FIGS. 29 and 30, the bottom wall of the enclosure 30D is formed with pairs of positioning studs 41 and anchoring studs 42 which are fitted respectively into positioning holes 21 and 22, as shown in FIGS. 24 and 26. The anchoring studs 42 are riveted to the base 10D by application of heat for securing the enclosure 30D to the base 10D, as shown in FIGS. 31 and 32 from which it is seen that the end of anchoring studs 42 is enlarged for engagement with the bottom of the base 10D. The riveting is made by the use of a horn or the like die which is pressed against the end of the anchoring studs 42 to upset the end with the application of the heat. It is noted in this connection that the anchoring studs 42 are backed with yokes 60D of the electromagnet block 50D received in the enclosure 30D (only one of the .studs 42 is seen in FIG. 32) for facilitating the riveting. Further, the electromagnet block 50D is tightly fitted within the enclosure 30D with the end flanges 54D abutted against the top wall of the enclosure 30D and with the lower ends of the yokes 60D abutted against the bottom wall of the enclosure 30D, so that the riveting is made after the electromagnet block 50D is assembled into the enclosure 30D and with the top wall of the enclosure 30D is held in position at a portion corresponding to the end flanges 54D by a suitable jig so as to concentrate the external force to the anchoring studs 42 for upsetting the ends thereof.

Figure 22:
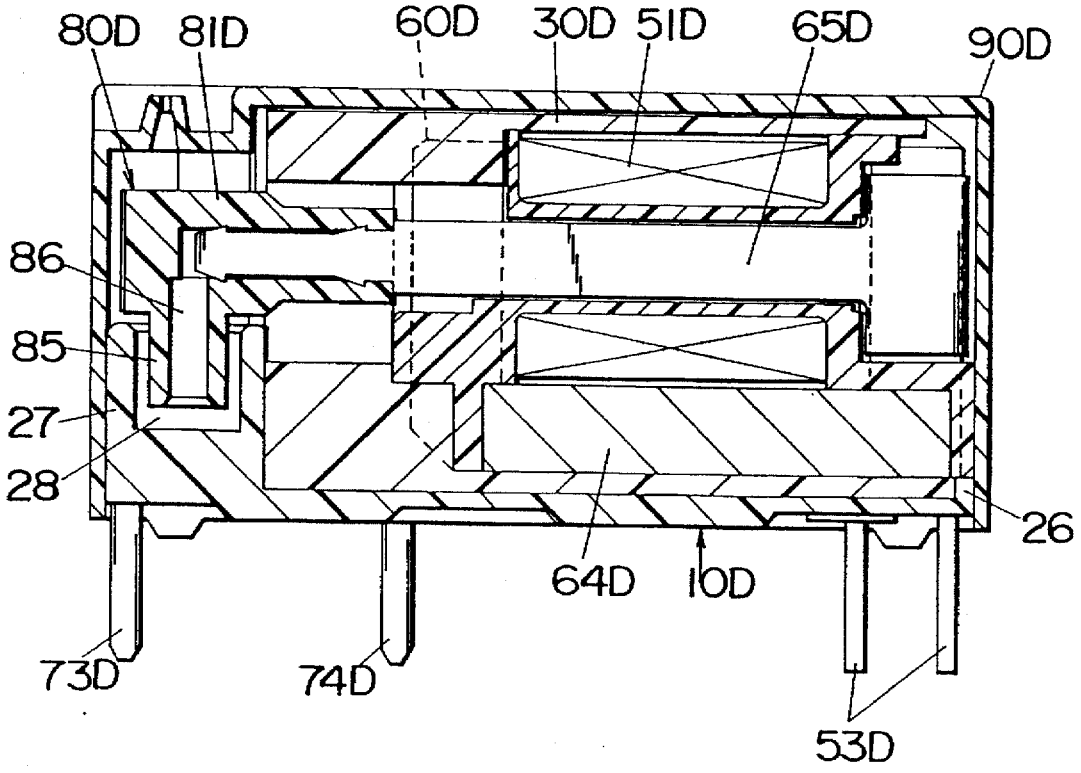
FIG. 22 is a vertical section of the above relay.
Figure 23:
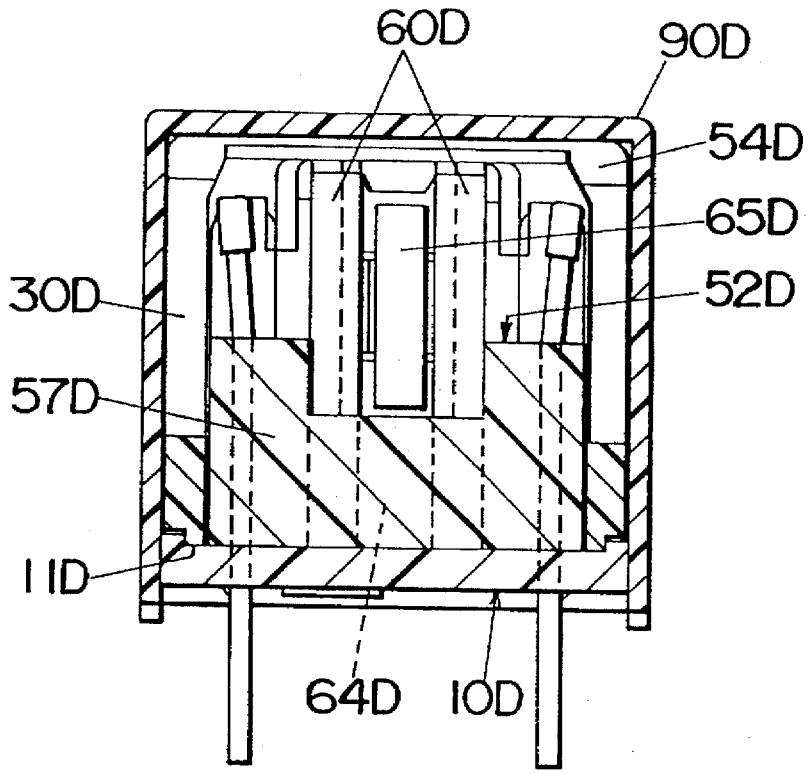
FIG. 23 is a sectional side view of the above relay.
Figure 27:
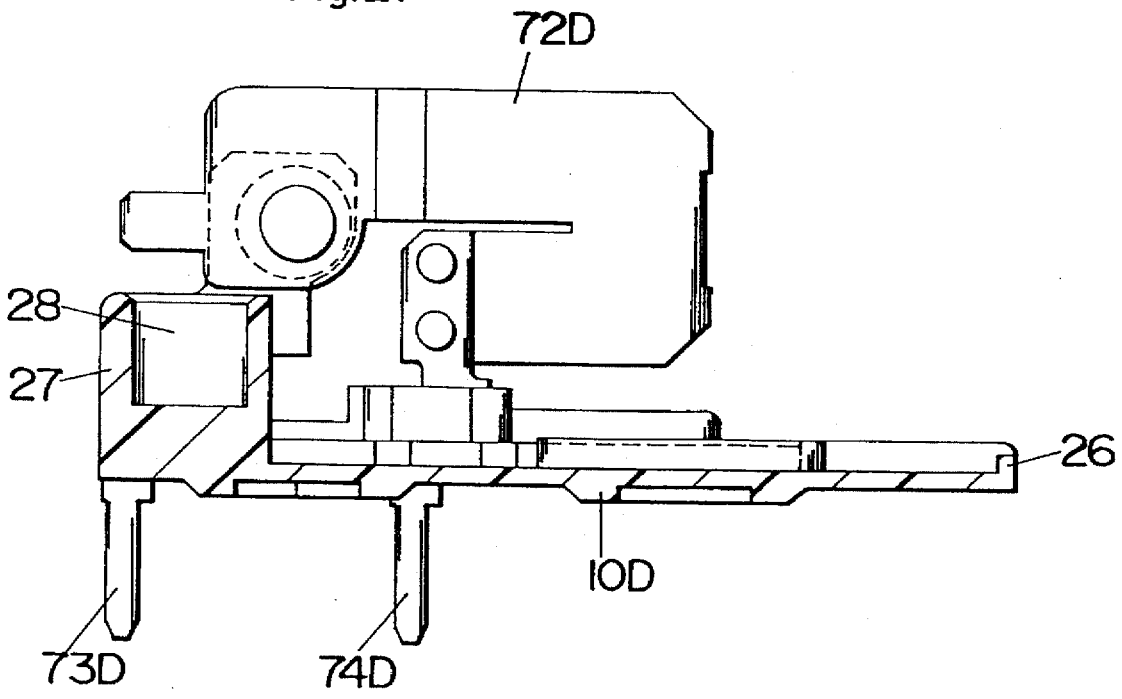
FIG. 27 is a vertical section of the above base.
Figure 28:
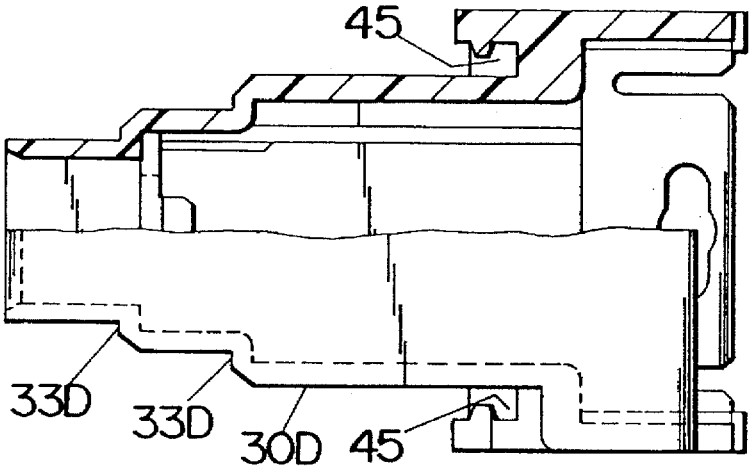
FIG. 28 is a plan view partly in section of the insulation enclosure.

As shown in FIG. 30, the bottom of the enclosure 30D is formed at its rear end with a pair of slits 43 for receiving therein the coil terminal 53D when the electromagnet block 50D is assembled into the enclosure 30D. When assembling the enclosure 30D on the base 10D, the coil terminals 53D are fitted to extend through corresponding holes 29, as shown in FIG. 26. Further, as shown in FIG. 30, the bottom of the enclosure 30D is formed with grooves 44 for receiving therein corresponding protrusions 24 formed on the base 10D, as shown in FIG. 26, which is also responsible for exactly positioning the enclosure 30D on the base 10D. Also formed on the base 10D are guide ribs 25 which extend in conformity with the stepped side walls of the enclosure 30D and are cooperative therewith to define grooves into which the lower ends of insulation partitions 91D of the cover 90D are received. The enclosure 30D itself is formed on opposite sides thereof with coves 45 which communicate with the groove and receive the rear ends of the partitions 91D. The bottom wall of the enclosure 30D is also formed at its rear end with a notch 46 which extends the full width of the enclosure 30D and receives therein a raised rim 26 at the rear end of the base 10D, as shown in FIGS. 22, 25, and 27. With this engagement, a sealing agent applied between the base 10D and the cover 90D can readily proceed between the lower end of the coil bobbin 52D and the bottom wall of the enclosure 30D and therefore act to adhere the coil bobbin 52D to the enclosure 30D.

The card 80D is molded to have a leg 85 depending from the trunk 81D with an aperture 86 which communicates with a stepped hole 83D receiving the front end of the armature 65D, as shown in FIG. 22. The aperture 86 is provided to introduce an adhesive for securing the armature 65D to the card 80D. The leg 85 projects into a cavity 28 formed in a projection 27 at the front end of the base 10D in order to prolong a creeping distance between the front end of the armature 65D and the adjacent contact blocks 70D, i.e., the movable contacts 72D, thereby assuring sufficient insulation therebetween. The leg 85 is engaged loosely in the cavity 28 and movable therein in response to the armature movement for the contacting operations.

Figure 33:
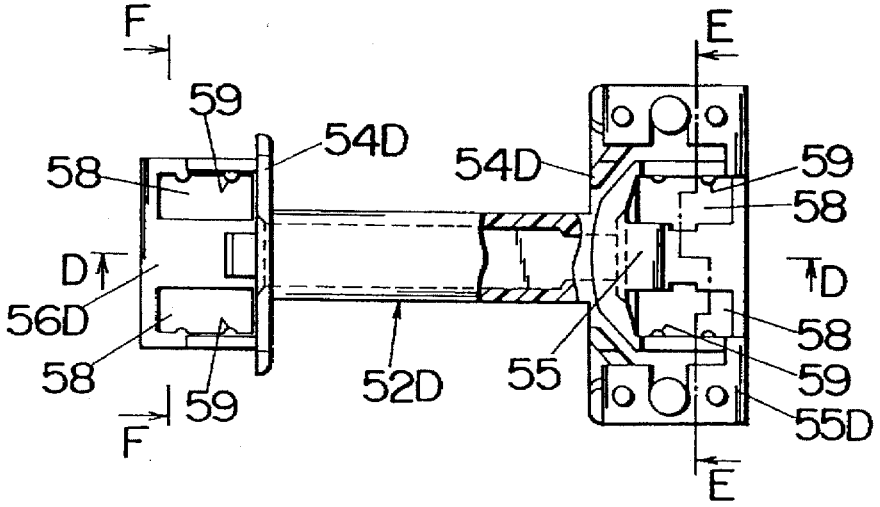
FIG. 33 is a top view partly in section of a coil bobbin utilized for the electromagnet.

As shown in FIG. 33, the coil bobbin 52D of the electromagnet block 50D is molded to integrally have the front extension 56D and the rear extension 57D which extend outwardly respectively from the end flanges 54D and are provided with positioning slots 58. It is through these positioning slots 58 that the vertical members 62D of the yokes 60D extend for mounting the yokes 60D to the coil bobbin 52D. Each of the slots 58 is formed with vertically extending squeezable protuberances 59 which are squeezed by contact with the vertical member 62D of the yoke 60 when the vertical member 62D is inserted into the slot 58, whereby the vertical member 62D is tightly held in the slot 58. The protuberances 59 are located on the outer side walls of the slots 58 so that the vertical members 62D of the opposed pair of the yokes 60D are pressed against flat inner side walls of the slots 58, whereby the opposed yokes 60D can be spaced accurately by a predetermined distance for providing dimensional stability between the yokes.

Figure 34:
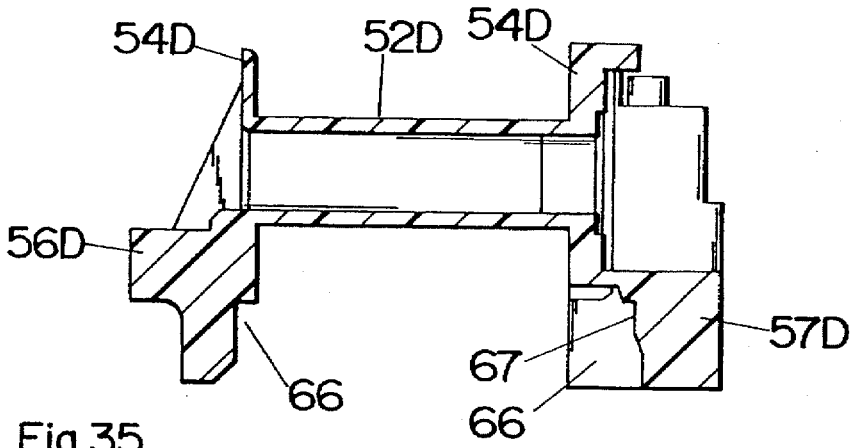
FIG. 34 is a cross section taken along line D—D of FIG. 33.
Figure 35:
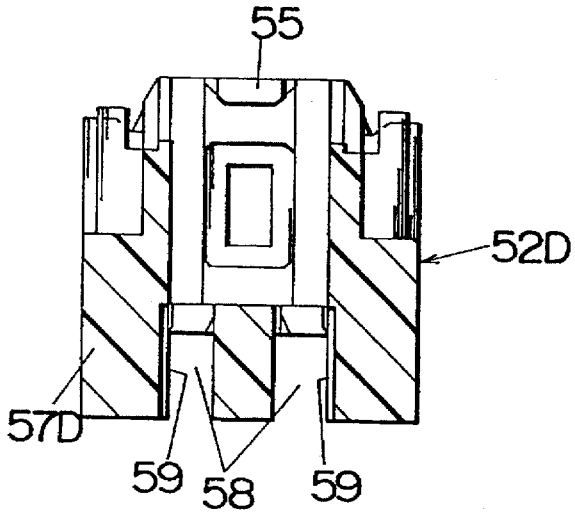
FIG. 35 is a cross section taken along line E—E of FIG. 33.
Figure 36:
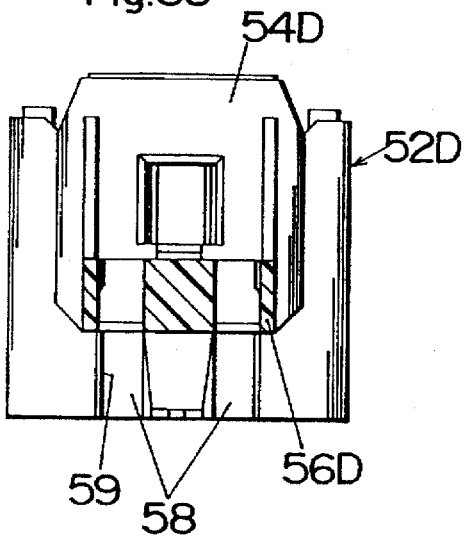
FIG. 36 is a cross-section taken along line F—F of FIG. 33.
Figure 37:
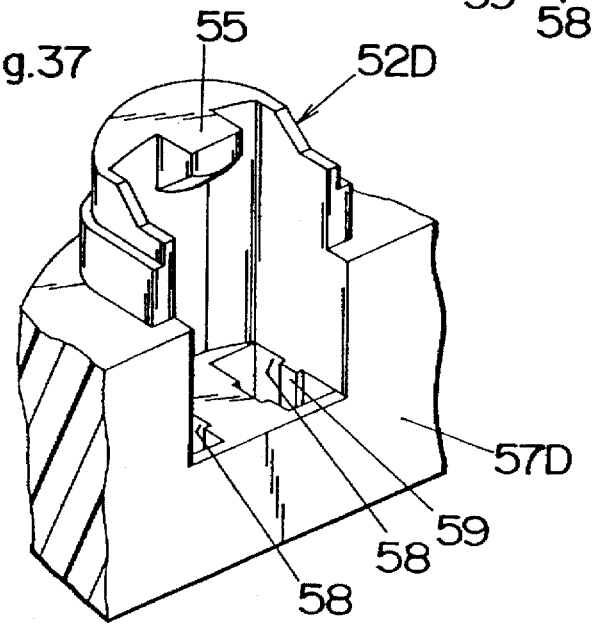
FIG. 37 is a perspective view illustrating an end of the coil bobbin.

As shown in FIGS. 33 and 37, the rear end flange 54D is formed with a bulge 55 which projects between the upper ends of the vertical members 62D of the adjacent yokes 60D and abuts against the vertical members 62D for preventing the yokes from tilting. As shown in FIG. 34, the front and rear extensions 56D and 57D are formed in its opposed inner surfaces with sockets 66 which receive the opposite ends of the permanent magnet 64D for positioning the permanent magnet between the opposed yokes 60D. One of the socket 66 is formed with a squeezable protuberance 67 which is pressed against by the end of the permanent magnet and is squeezed for stably holding the permanent magnet 64D in the coil bobbin 52D without applying any stress to the yokes 60D. Therefore, the permanent magnet 64D can be held between the yokes 60D without sacrificing the dimensional stability of the yokes. Although the above bulge 55 and the protuberance 67 are shown in the figure to be formed on the rear of the coil bobbin 52D, they may be additionally formed on the front of the coil bobbin.

What is claimed is:

1. An electromagnetic relay comprising:

a base provided with an insulation enclosure made of an electrically insulative material to have a longitudinal axis, said insulation enclosure being opened at its opposite longitudinal ends to have a front opening and a rear opening, and having a top wall, side walls, and a bottom wall contiguous along the length of and around the periphery of said enclosure, respectively;

a contact block comprising at least one pair of a movable contact and a fixed contact disposed on said base outwardly of said enclosure adjacent the side wall thereof;

an electromagnet block received within said enclosure through said rear opening thereof, said electromagnet block comprising a coil, yokes, and an armature extending through said coil and along the length of said enclosure, said armature being magnetically coupled to said coil so as to move relative to said yokes upon energization of said coil;

a card of electrically insulative material connecting said armature to said movable contact so that the relative movement of said armature to said yokes is transmitted to close and open said contacts;

a cover of an electrically insulative material fitted around said base to encase said contact block, said electromagnet block, and said card between said cover and said base, said cover formed with at least one insulation partition which depends from a top wall of said cover to extend between said insulation enclosure and said contact block;

said card comprising a trunk and a crosspiece, said trunk being connected to said armature, and said crosspiece extending from said trunk for connection with said movable contact outwardly of said insulation enclosure and said insulation partition, wherein the trunk extending into said insulation enclosure through said front opening thereof to fit around the longitudinal end of said armature such that the entire length of said armature is insulated from said contact block by the top wall, the side wall and the bottom wall of said enclosure and by the trunk, said crosspiece extending from said trunk longitudinally outwardly of said insulation enclosure in a transverse relation to the length of said insulation enclosure, and wherein said insulation partition is contiguous along substantially the entire length of said enclosure.

2. The electromagnetic relay as set forth in claim 1, wherein said insulation partition has its front end projecting longitudinally outwardly of said insulation enclosure in an overlapping relation to said trunk of the card.

3. The electromagnetic relay as set forth in claim 1, wherein said base is formed with a groove which extends along side wall of said enclosure for receiving the lower end of said insulation partition.

4. The electromagnetic relay as set forth in claim 1, wherein said insulation enclosure having a width which is narrower towards said front opening than at said rear opening, said width being defined as a dimension between the outer surfaces of said side walls, said insulation partition being fitted snugly over said enclosure.

5. The electromagnetic relay as set forth in claim 4, wherein said side wall of said insulation enclosure is formed with at least one step by which the width of said enclosure is narrower towards said front opening.

6. The electromagnetic relay as set forth in claim 4, wherein said base is formed with a groove which extends along the side wall of said enclosure for receiving the lower end of said insulation partition.

7. The electromagnetic relay as set forth in claim 1, wherein two pairs of said movable contacts and said fixed contacts are mounted on opposite sides of said insulation enclosure, and wherein said card is in the form of a generally T-shaped configuration with said trunk and said crosspiece, said crosspiece being connected at its opposite ends respectively to said movable contacts longitudinally and laterally outwardly of said insulation enclosure and said insulation partition.

8. The electromagnetic relay as set forth in claim 1, wherein said base comprises a first sub-base and a second sub-base which are molded separately from each other, said first sub-base carrying said movable and fixed contacts which are molded-in into said first sub-base, and said second sub-base being molded integrally with said insulation enclosure.

9. The electromagnetic relay as set forth in claim 8, wherein said second sub-base is formed with anchor studs which are fitted into corresponding holes in said first sub-base and are riveted by an application of heat to said first sub-base for securing said second sub-base to said first sub-base.

10. The electromagnetic relay as set forth in claim 8, wherein said first sub-base is formed with anchor studs which are fitted into corresponding holes in said second sub-base and are riveted by an application of heat to said second sub-base for securing said first sub-base to said second sub-base.

11. The electromagnetic relay as set forth in claim 9, wherein said insulation enclosure receives said electromagnet block with the bottom of said yokes pressed against the bottom wall of said insulation enclosure at such portions that said yokes bear a force applied when said anchor studs are riveted to said first sub-base.

12. The electromagnetic relay as set forth in claim 1, wherein said base comprises a first sub-base, a second sub-base, and third sub-base which are molded separately from each other, each of said first and second sub-bases carrying the movable contact and the fixed contact which are molded-in into each of said first and second sub-bases, and said third sub-base being molded to have said insulation enclosure integrally therewith.

13. The electromagnetic relay as set forth in claim 1, wherein said base comprises a first sub-base and a second sub-base which are molded separately from each other, each said first and second sub-bases carrying the pair of said movable contact and said fixed contact which are molded-in into each of the first and second sub-bases, said first and second bases being molded to have integral halves which are cooperative to form said insulation enclosure.

14. The electromagnetic relay as set forth in claim 1, wherein said insulation enclosure is molded separately from said base and is assembled on said base with the bottom wall of said insulation enclosure placed upon the base, said bottom wall of said insulation enclosure being cut away at its rear end to define thereat a notch into which a raised rim at the rear end of Said base fits, said electromagnet block including a coil bobbin for winding therearound said coil, said coil bobbin having a rear end of which lower end abuts against said raised rim of said base through said notch such that a sealing agent filled through between said case and the base can reach a portion between said coil bobbin and said base.

15. The electromagnetic relay as set forth in claim 1, wherein said electromagnet block includes a coil bobbin for winding therearound said coil, said coil bobbin having a longitudinal axis and formed at its opposite axial ends with end flanges, each of said yokes being of a generally U-shaped configuration with a horizontal member and a pair of vertical members extending from the opposite ends of a horizontal member, said yokes being mounted on said coil bobbin in laterally spaced relation with each other to define between the opposed vertical members gaps in which said armature extends, said coil bobbin including front and rear extensions which project respectively longitudinally outwardly of said end flanges and being formed with positioning slots through which said vertical members of said yokes extend snugly.

16. The electromagnetic relay as set forth in claim 15, wherein one of said end flanges is formed with a positioning projection which engages with the upper end of said vertical member of at least one Said yoke upwardly of said armature.

17. The electromagnetic relay as set forth in claim 15, wherein said coil bobbin is formed in its bottom with a socket into which a permanent magnet is press-fitted in a closely adjacent relation to the horizontal members of the yokes so that the yokes are magnetized to the opposite polarity.

* * * * *